US005821953A

United States Patent [19]

Nakano et al.

[11] Patent Number: 5,821,953

[45] Date of Patent: Oct. 13, 1998

[54] INK-JET HEAD DRIVING SYSTEM

[75] Inventors: Tomoaki Nakano, Kawasaki; Tetsuro Hirota, Hadano, both of Japan

[73] Assignee: Ricoh Company, Ltd., Tokyo, Japan

[21] Appl. No.: 582,907

[22] Filed: Jan. 4, 1996

[30] Foreign Application Priority Data

| | | | |
|---|---|---|---|
| Jan. 11, 1995 | [JP] | Japan | 7-002834 |
| Oct. 5, 1995 | [JP] | Japan | 7-258602 |

[51] Int. Cl.[6] ..... B41J 2/045

[52] U.S. Cl. ..... 347/10

[58] Field of Search ..... 347/5, 9, 10, 11, 347/12

[56] References Cited

U.S. PATENT DOCUMENTS

| | | | |
|---|---|---|---|
| 4,184,168 | 1/1980 | Isayama et al. | 347/9 |
| 4,471,363 | 9/1984 | Hanaoka | 347/10 |
| 4,714,935 | 12/1987 | Yamamoto et al. | 347/10 |
| 5,146,236 | 9/1992 | Hirata et al. | 347/12 |
| 5,221,931 | 6/1993 | Moriyama | 347/10 |
| 5,266,965 | 11/1993 | Komai et al. | 347/12 |
| 5,359,350 | 10/1994 | Nakano et al. | 347/10 |
| 5,563,634 | 10/1996 | Fujii et al. | 347/9 |
| 5,594,476 | 1/1997 | Tokunaga et al. | 347/10 |
| 5,668,579 | 9/1997 | Fujii et al. | 347/10 |
| 5,689,291 | 11/1997 | Tence et al. | 347/10 |

FOREIGN PATENT DOCUMENTS

| | | | |
|---|---|---|---|
| 51-104224 | 9/1976 | Japan | B41J 3/04 |
| 55-27281 | 2/1980 | Japan | B41J 3/04 |
| 59-136266 | 8/1984 | Japan | B41J 3/04 |
| 60-8953 | 3/1985 | Japan | B41J 3/04 |
| 61-242850 | 10/1986 | Japan | B14J 3/04 |
| 62-77949 | 4/1987 | Japan | B41J 3/04 |

*Primary Examiner*—Adolf Berhane
*Attorney, Agent, or Firm*—Cooper & Dunham LLP

[57] ABSTRACT

A minimum per-time voltage-increase gradient during a time a driving voltage is being increased is not less than ⅛ a maximum per-time voltage-increase gradient during said time the driving voltage is being increased. A driving-voltage increase amount which the driving voltage is increased during a time, within a predetermined time, during which a per-time voltage-increase gradient is maintained at a maximum voltage is not less than ½ of a full driving-voltage increase amount which the driving voltage is increased during said predetermined time. When the driving voltage is decreased, a per-time voltage-decrease gradient when said voltage decrease is started is sharper than an average per-time voltage-decrease gradient, and a per-time voltage-decrease gradient when said voltage decrease is ended is less sharp than the average per-time voltage-decrease gradient. Further, a time during which a per-time voltage-decrease gradient is maintained less sharp than said average per-time voltage-decrease gradient is not less than ½ a full time during which the driving voltage is being decreased.

23 Claims, 31 Drawing Sheets

FIG.3A
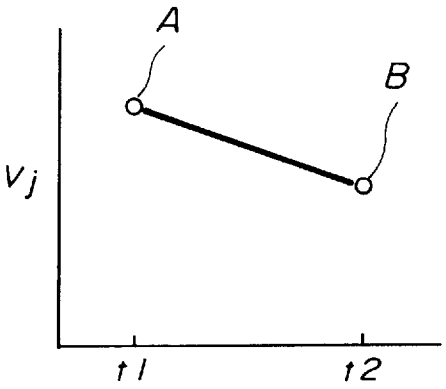
FIG.3B
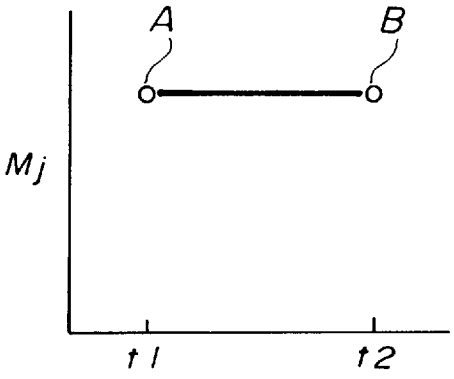
FIG.4A
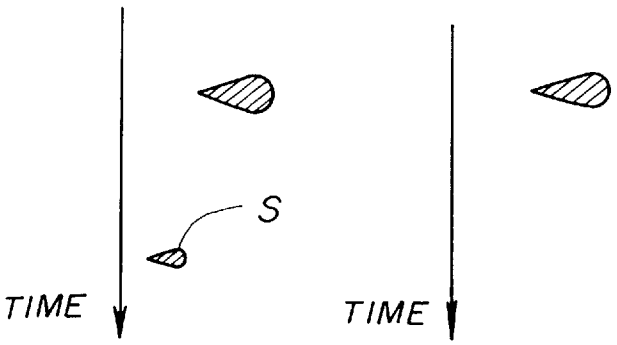
FIG.4B
FIG.4C
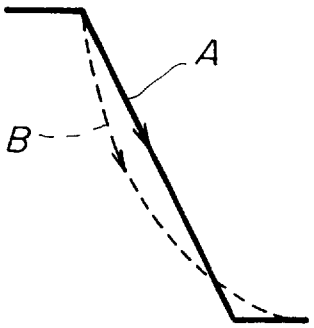

INK-JET HEAD DRIVING SYSTEM

BACKGROUND OF THE INVENTION

1. Field of the Invention

The present invention relates to an ink-jet head driving system used for performing an ink-jet printing method.

2. Description of the Related Art

A drop-on-demand (DOD) method, in which ink is fired only when a recording signal is input, is mainly used as the ink-jet printing method. There are a bubble-jet method and a piezoelectric-actuator method in the DOD method. The bubble-jet method is disclosed in Japanese Patent Publication No.61-59913 and uses bubbles generated in ink due to heat energy. The piezoelectric-actuator method is disclosed in Japanese Patent Publication No.60-8953 and uses a piezoelectric element.

An ink-jet head used in the piezoelectric-actuator method is provided with a nozzle, a liquid chamber communication with the nozzle, and a piezoelectric element for compressing the liquid chamber. A pulse-waveform driving voltage is applied to the piezoelectric element and thus the piezoelectric element is elongated and shortened. Thereby, the liquid chamber is compressed and thus ink in the liquid chamber is fired via the nozzle.

FIGS. 1A and 1B show examples of a waveform of a pulse of the above-mentioned pulse-waveform driving signal to be applied to the piezoelectric element of the ink-jet head. A driving circuit supplying the waveform shown in FIG. 1A is disclosed in Japanese Laid-Open Patent Application No.59-136266. In this waveform, a voltage increases and decreases linearly, thus producing a trapezoidal voltage pulse as shown in the figure. A driving circuit supplying the waveform shown in FIG. 1B is disclosed in Japanese Laid-Open Patent Application No.51-104224. In this waveform, a voltage increases and decreases non-linearly but with time-constant characteristics, thus producing more curved trapezoidal voltage pulse as shown in the figure. The liquid chamber is compressed according to a voltage increase of the driving signal and thus ink in the chamber is fired via the nozzle. The liquid chamber is decompressed according to a voltage decrease of the driving signal and thus a vacuum pressure is generated in the liquid chamber.

However, using either of the above-mentioned waveforms of the driving signals for driving the ink-jet head, it is difficult to have a high ink firing efficiency and also a desired high frequency response. A solid-line curve A shown in FIG.2 indicates higher-harmonic components which are included in the driving signal having the waveform shown in FIG. 1A when the voltage increases. A broken-line curve B shown in FIG. 2 indicates higher-harmonic components which are included in the driving signal having the waveform shown in FIG. 1B when the voltage increases.

In the waveform shown in FIG. 1A, because the voltage increases linearly, a gradient of the voltage curve varies sharply when the voltage increase starts and when it ends as shown in the figure. Accordingly, the included higher-harmonic components are larger as shown in FIG. 2. Thereby, a pressure wave, which is generated in the liquid chamber driven by the piezoelectric element driven by the driving signal, may not be attenuated rapidly after ink firing is finished. Accordingly, it is not possible to restart a subsequent ink firing quickly, and thus the frequency response is degraded. In contrast to this, if the waveform shown in FIG. 1B is used instead, because the gradient of the voltage curve gradually decreases at the end of the voltage increase, the included higher-harmonic components are smaller. Accordingly, the frequency response is improved.

FIGS. 3A and 3B show a comparison between cases of using the driving signals having the waveforms shown in FIGS. 1A and 1B with respect to ink firing velocities Vj and ink firing volumes Mj, respectively. As shown in FIG. 3B, an ink firing volume (represented by a point 'B' in the figure) when using the driving signal of the waveform shown in FIG. 1B is the same as that (represented by a point 'A' in the figure) of the waveform shown in FIG. 1A. However, as shown in FIG. 3A, an ink firing velocity (represented by a point 'B' in the figure) when using the driving signal of the waveform shown in FIG. 1B is smaller by approximately 35% than that (represented by a point 'A' in the figure) of the waveform shown in FIG. 1A. This is because, while the ink firing volume Mj depends on a pulse span Pw of the driving signal, the ink firing velocity depends on a level of a pressure generated during a time 'tr' in which the voltage of the driving signal increases. In the waveform shown in FIG. 1B, because the gradient of the voltage increase curve is gradually decreased as shown in the figure, the level of the pressure thus generated is lower.

In each of the graphs shown in FIGS. 3A and 3B, the horizontal axis represents a rise time tr during which the voltage rises to the peak voltage in the driving waveform. The rise time t1 in the waveform shown in FIG. 1A is shorter than the rise time t2 in the waveform shown in FIG. 1B. Thus, t1<t2.

FIG. 4C comparatively shows the waveforms (indicated by 'A' and 'B') shown in FIGS. 1A and 1B respectively when the voltage decreases. As shown in FIG. 4C, the gradient of the waveform shown in FIG. 1A is less sharp than that of the waveform shown in FIG. 1B when the decrease starts. Accordingly, when using the waveform shown in FIG. 1A (indicated by 'A' in FIG. 4C), a vacuum pressure generated in the liquid chamber is not sufficiently large and thus an unnecessary drop S (referred to as a satellite) may occur as a result of leakage from the liquid chamber after a firing action is finished as shown in FIG. 4A. The satellite S forms a small unexpected dot adjacent to a dot according to image data, disturbs a dot shape according to the image data, and thus degrades an image quality. In each of FIGS. 4A and 4B, the vertical axis represents a time and the horizontal axis represents an ink-drop going direction.

In contrast to this, when using the waveform shown in FIG. 1B (indicated by 'B' in FIG. 4C), the sharper gradient of the voltage decrease of the driving signal shown in FIG. 4C may cause a sufficient vacuum pressure to be generated in the liquid chamber. The sufficient vacuum pressure may suck such an unnecessary drop and thus prevent such a satellite from occurring as a result of leakage from the chamber, as shown in FIG. 4B. Further, the gradient of the waveform shown in FIG. 1B (indicated by 'B' in FIG. 4C) is then gradually less sharp as shown in FIG. 4C and thus no pressure wave may remain after the voltage decrease is finished. As a result, a subsequent ink firing action may be rapidly started and thus the frequency response is improved.

Thus, the driving signal of the waveform of FIG. 1A has a superior ink firing velocity Vj. However, large higher-harmonic components are included in the signal because the gradient of the voltage increase varies sharply when the increase starts and when it ends, and also the gradient of the voltage decrease varies sharply when the decrease starts and when it ends. Thereby, a pressure wave may not be attenuated rapidly after the ink firing action, and thus a subsequent ink firing action cannot be started rapidly. As a result, the frequency response is not superior.

In contrast to this, in the driving signal of the waveform of FIG. 1B, the gradient of the voltage increase is gradually less sharp at the end thereof and also the gradient of the voltage decrease is gradually less sharp at the end thereof, as shown in FIG. 1B. Accordingly, smaller higher-harmonic components are included in the signal, and thereby, a pressure wave may be attenuated rapidly after the ink firing action, and thus a subsequent ink firing action can be started rapidly. As a result, the frequency response is superior. However, as shown in FIG. 3A, the ink firing velocity may not be sufficient. As a result, a printed-image quality may be degraded.

Consequently, each one of the waveforms shown in FIGS. 1A and 1B has problems or disadvantages.

An ink-jet printing apparatus for performing the ink-jet printing method uses an ink-jet head, including a plurality of nozzles for firing ink drops and actuators such as electromechanical transducers, heating resistance elements or the like provided for the plurality of nozzles respectively. A recording signal or driving signal is supplied to the actuators and the ink drops are fired via the nozzles according to the thus-supplied signal. The thus-fired ink drops then reach a recording sheet material (such as a sheet of paper) and thus adhere thereto. Thus, a printing operation is performed at high speed, high density and high quality.

In such an ink-jet printing apparatus, generally speaking, when an ambient temperature varies, ink firing characteristics of the ink-jet head may vary accordingly. Specifically, the ink firing velocity Vj and ink firing volume Mj may vary. If such variation occurs, an image quality resulting from the printing operation may be degraded. Specifically, when the ambient temperature is high, an ink viscosity decreases, the ink firing velocity Vj and/or ink firing volume Mj thus increase, and it is likely that unnecessary satellites such as those mentioned above occur. In contrast to this, when the ambient temperature is low, the ink viscosity increases, and thus the ink firing velocity Vj and/or ink firing volume Mj may decrease and thus become insufficient for keeping a printed image quality.

In conjunction with these tendencies, Japanese Laid-Open Patent Application No.61-242850 discloses an ink-jet printing apparatus. This apparatus includes a recording head for firing ink drops to a recording sheet material and thus recording an image thereon. This apparatus further includes energy supplying means for supplying energy to the recording head for firing ink drops and the energy to be supplied to the recording head may be adjusted. This apparatus further includes temperature detecting means for detecting a temperature of the recording head, and energy adjusting means for adjusting the energy being supplied to the recording head according to the thus-detected temperature.

However, if a plurality of recording heads are used in the printing apparatus, the temperature detector and energy adjusting means should be provided for each recording head. As a result, the printing apparatus is complicated and expensive.

There are an ink-jet printing apparatus in which a plurality of nozzles are provided for a common ink-jet head and another ink-jet printing apparatus having a plurality of ink-jet heads. In each of these ink-jet printing apparatuses, uniformity in ink firing characteristics among the plurality of nozzles or among the plurality of ink-jet heads may be degraded. If the uniformity is degraded, positions of dots resulting from fired ink drops adhering to the recording sheet material may shift from predetermined ones, or colors may shift from predetermined ones or may be blurred when the color printing is performed.

In conjunction with the above-described problems, Japanese Patent Publication No.6-24863 discloses an ink-jet printing apparatus. This apparatus has one recording head having a plurality of electrothermal transducers, and voltage setting resistors for adjusting driving voltages for particular firing voltages of the respective electrothermal transducers. The apparatus further includes a constant voltage circuit which is electrically connected with the voltage setting resistors, adjusts these driving voltages according to the voltage setting resistors, and outputs the thus-adjusted driving voltages. The constant voltage circuit compares feedback signals of the driving voltages with a reference voltage and thus preforms a feedback control operation.

However, if a plurality of recording heads are used in the printing apparatus, the constant voltage circuit, which includes transistors, operation amplifiers and so forth, should be provided for each recording head. As a result, a wide space is required for provision of each recording head and also costs required for each recording head are high.

SUMMARY OF THE INVENTION

An object of the present invention is to provide a driving circuit for an ink-jet head, thereby improving ink firing efficiency and frequency response.

Another object of the present invention is to provide a driving circuit for an ink-jet head, thereby improving, even with a simple system arrangement and low costs, a printed image quality.

An ink-jet head driving circuit according to the present invention, comprises:

a liquid chamber containing ink and firing said ink in response to an applied pressure;

a piezoelectric element applying the pressure to said liquid chamber; and voltage applying means applying a driving voltage to said piezoelectric element in a manner in which the voltage being applied is sharply increased immediately after a voltage increase is started and then gently but substantially increased until said voltage increase is ended.

Another ink-jet head driving circuit according to the present invention comprises:

a liquid chamber containing ink and firing said ink in response to an applied pressure;

a piezoelectric element applying the pressure to said liquid chamber; and voltage applying means applying a driving voltage to said piezoelectric element in a manner in which a minimum per-time voltage-increase gradient during a time the driving voltage is being increased is not less than ⅛ a maximum per-time voltage-increase gradient during said time the driving voltage is being increased.

Another ink-jet head driving circuit according to the present invention comprises:

a liquid chamber containing ink and firing said ink in response to an applied pressure;

a piezoelectric element applying the pressure to said liquid chamber; and voltage applying means applying a driving voltage to said piezoelectric element in a manner in which a driving-voltage increase amount which the driving voltage is increased during a time, within a predetermined time, during which a per-time voltage-increase gradient is maintained at a maximum one is not less than ½ of a full driving-voltage increase amount which the driving voltage is increased during said predetermined time.

Thereby, when a pressure applied to the ink-jet head is increased, higher-harmonic components are suppressed and thus a high-frequency driving capability is improved.

Another ink-jet head driving circuit according to the present invention comprises:

a liquid chamber containing ink and firing said ink in response to an applied pressure;

a piezoelectric element applying the pressure to said liquid chamber; and voltage applying means applying a driving voltage to said piezoelectric element in a manner in which:

when the driving voltage is decreased, a per-time voltage-decrease gradient when said voltage decrease is started is sharper than an average per-time voltage-decrease gradient, and a per-time voltage-decrease gradient when said voltage decrease is ended is less sharp than the average per-time voltage-decrease gradient; and in addition, a time during which a per-time voltage-decrease gradient is maintained less sharp than said average per-time voltage-decrease gradient is not less than ½ a full time during which the driving voltage is being decreased.

Thereby, when a pressure applied to the ink-jet head is decreased, a pressure wave is prevented from remaining after ink-drop firing is finished, and thus, formation of an unnecessary satellite is prevented. Thus, ink firing efficiency can be improved.

It is preferable that said voltage applying means comprises:

voltage increasing means for increasing the driving voltage until reaching a power source voltage; and peak cutting means for preventing the driving voltage from increasing above a predetermined peak driving voltage which is less than said power source voltage. Further, said predetermined peak driving voltage is not larger than 9/10 said power source voltage. Thereby, an appropriate driving waveform fulfilling the above-described conditions can be easily obtained.

Further, it is preferable that the driving voltage waveform is obtained using a power source voltage Vs and a predetermined peak driving voltage Vp. An increase of the driving voltage is stopped when the voltage reaches the predetermined peak driving voltage Vp. Thus, precise waveform control can be achieved.

Further, it is preferable that said predetermined peak driving voltage is defined by a certain voltage which is obtained as a result of distributing, through resistors, said power source voltage. Thereby, the driving voltage can be controlled, for a purpose of eliminating a possible difference among the heads and so forth, by an easy circuit arrangement with low costs.

Further, it is also preferable that a Zener diode is used for limiting the driving voltage at said predetermined peak driving voltage. Thereby, a relevant circuit can be formed with low costs and require a reduced mounting space.

Further, it is preferable that:

said liquid chamber comprises a plurality of liquid chambers;

said piezoelectric element comprises a plurality of piezoelectric elements for applying pressure to said plurality of liquid chambers respectively;

and the driving voltage is supplied to said plurality of piezoelectric elements using a common conductor.

Thereby, the ink-jet head can be miniaturized and manufactured with low costs, and also a number of signal wires between a printing apparatus body and the ink-jet head can be significantly reduced.

Another ink-jet head driving circuit according to the present invention comprises:

a plurality of head driving circuits, relevant to a plurality of ink-jet heads respectively;

environmental condition detecting means, detecting environmental conditions; and voltage control means for commonly adjusting a driving voltage applied to said plurality of head driving circuits based on a detection result of said environmental condition detecting means.

As a result, even using a simple low-cost circuit arrangement, ink-drop firing characteristics of the plurality of ink-jet heads are adjusted according to environmental conditions and thus a printed-image quality can be improved.

Another ink-jet head driving circuit according to the present invention comprises:

a plurality of head driving circuits, relevant to a plurality of ink-jet heads respectively;

environmental condition detecting means, detecting environmental conditions;

data processing means, based on a detection result of said environmental condition detecting means, generating a bit signal representing a driving voltage commonly applied to said plurality of head driving circuits;

voltage control means, commonly adjusting the driving voltage applied to said plurality of head driving circuits according to said bit signal.

As a result, even using a simple low-cost circuit arrangement, ink-drop firing characteristics of the plurality of ink-jet heads are adjusted according to environmental conditions and thus a printed image quality can be improved. In addition, by providing the data processing means, it is possible to further accurately or finely adjust the driving voltage supplied to the head driving circuits.

It is preferable that said environmental condition detecting means comprises resistor circuit including a thermistor detecting an ambient temperature. Thereby, even using such a simple arrangement as the environmental condition detecting means, an ambient temperature is effectively detected and also used for adjusting the driving voltage.

Another ink-jet head driving circuit according to the present invention comprises:

a plurality of head driving circuits, relevant to a plurality of ink-jet heads respectively;

environmental condition setting means for an operator to set environmental conditions;

data processing means, based on a setting performed through said environmental condition setting means, generating a bit signal representing a driving voltage commonly applied to said plurality of head driving circuits;

voltage control means, commonly adjusting the driving voltage applied to said plurality of head driving circuits according to said bit signal.

As a result, using a simple low-cost circuit arrangement, a desired image quality can be selected.

Another ink-jet head driving circuit according to the present invention comprises a plurality of head driving circuits, relevant to a plurality of ink-jet heads respectively, each head driving circuit including a waveform generating circuit generating a driving waveform to be applied to a respective one of said plurality of ink-jet heads, at least one component of said waveform generating circuit being mounted on said respective one of said plurality of ink-jet heads, and thus enabling change of the driving waveform for each ink-jet head independently from the others of said plurality of ink-jet heads.

Thereby, it is possible to eliminate a difference of ink-drop firing characteristics among particular heads or a difference in ink property among particular ink colors by adjusting driving voltage waveforms of respective heads. Accordingly, it is possible to improve printed image quality with a simple low-cost apparatus arrangement.

It is preferable that:

further, a power source voltage is supplied commonly to said plurality of head driving circuits; and said power source voltage is adjusted according to environmental conditions.

Thereby, fluctuation in ink-drop firing characteristics due to environmental conditions can also be eliminated.

It is preferable that:

said waveform generating circuit of each head driving circuit includes a clipping circuit clipping a driving voltage of the driving waveform; wherein at least one resistor or Zener diode used in said clipping circuit is mounted on a respective one of said plurality of ink-jet heads, and thus a change in the driving voltage of the driving waveform is enabled for each ink-jet head independently from the others of said plurality of ink-jet heads.

Thereby, a possible difference in ink-drop firing characteristics among heads can be easily eliminated.

It is preferable that:

said waveform generating circuit of each head driving circuit includes a circuit generating, as the driving waveform, a voltage waveform relevant to a capacitor which is charged and discharged via a resistor; wherein at least one of said resistor and capacitor is mounted on a respective one of said plurality of ink-jet heads, and thus changes in a rising time constant and a decaying time constant of the driving waveform are enabled for each ink-jet head independently from the others of said plurality of ink-jet heads.

Thereby, it is possible to make ink-drop firing characteristics uniform among the plurality of ink-jet heads. Accordingly it is possible to prevent a dot printed position on a recording sheet material from unexpectedly differing. Thus, a printed-image quality can be improved.

It is preferable that a plurality of resistors or capacitors and switch selecting means selecting at least one of said plurality of resistors or capacitors according to a given bit signal are mounted on each of said plurality of ink-jet heads. Thereby, a resistance or a capacitance can be automatically adjusted and thus a possible difference in ink-drop firing characteristics among heads can be easily eliminated.

Other objects and further features of the present invention will become more apparent from the following detailed description when read in conjunction with the accompanying drawings.

BRIEF DESCRIPTION OF THE DRAWINGS

FIGS. 3A and 3B show comparison of ink firing velocities and ink firing volumes between cases of using the driving signals of the waveforms shown in FIGS. 1A and 1B;

FIGS. 4A, 4B and 4C illustrate ink firing states when using the driving signals of the waveforms shown in FIGS. 1A and 1B;

DESCRIPTION OF THE PREFERRED EMBODIMENTS

An ink-jet head driving circuit in first, second, third, fourth, fifth, sixth, seventh and eighth embodiments of the present invention will now be described with reference to accompanying relevant figures.

Figure 5:
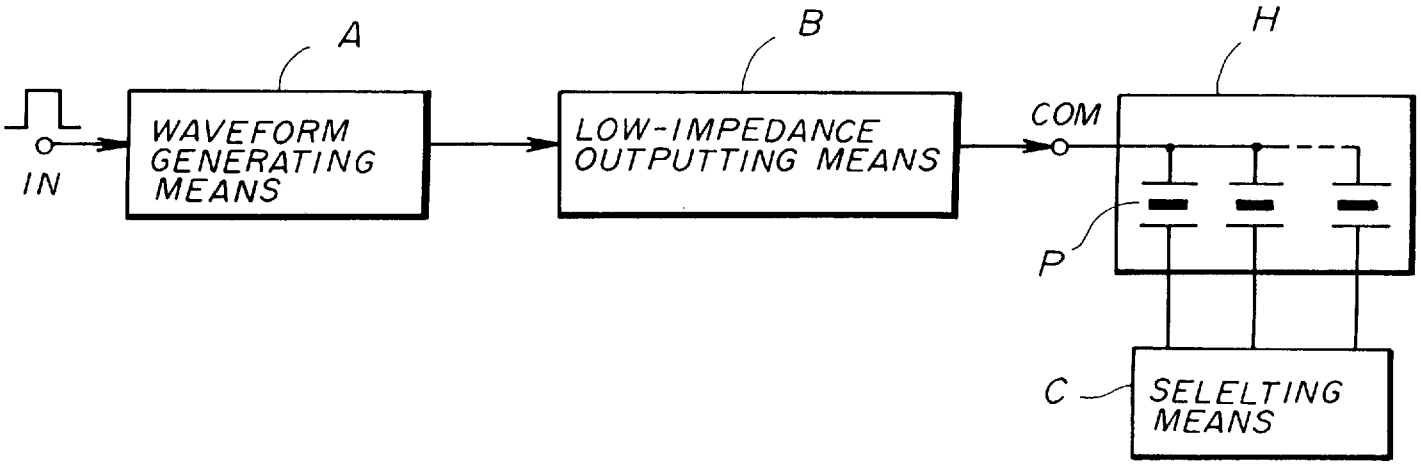
FIG. 5 shows a block diagram of first, second, third, fourth, fifth, sixth, seventh and eighth embodiments of the present invention.

With reference to FIG. 5, this ink-jet head driving circuit includes waveform generating means A and low-impedance outputting means B. The waveform generating means A generates voltage waveforms from square-wave pulses, which waveforms fulfill the following expressions (1) and (2) when applying a pressure to ink:

$$\alpha n \geqq (1/8)*\alpha m \quad (1);$$

and $$V\alpha m \geqq (1/2)*Vp \quad (2).$$

The waveform generating means A generates voltage waveforms from the square-wave pulses, which waveforms fulfill the following expressions (3) and (4) when reducing a pressure applied to the ink:

$$\beta 1 > (Vp/tf) > \beta k \quad (3);$$

and $$tf\beta 1 \geqq (1/2)*tf \quad (4).$$

In the above expressions, 'αn' is the minimum one of a driving-voltage per-time gradient α (ΔV/Δt) during a voltage applying time tr during which a driving voltage V is applied to a piezoelectric element for applying a pressure to an ink in a liquid chamber in an ink-jet head. 'αm' is the maximum one of the driving-voltage per-time gradient α (ΔV/Δt) during the voltage applying time tr. Further, 'Vαm' is a voltage increase amount which the driving voltage increases during a time the driving-voltage per-time gradient is maintained to be αm. 'Vp' is the peak one of the driving voltage V to which the driving voltage is increased and thus ink is fired from the liquid chamber via a nozzle.

Then, thus-increased pressure of the ink in the liquid chamber is reduced as a result of reducing a pressure applied to the liquid chamber. The liquid-chamber pressure reduction is performed as a result of reducing a driving voltage V applied to the piezoelectric element. When the driving voltage V is reduced, a driving-voltage per-time gradient (ΔV/Δt) will be referred to as '−β'. Further, the driving voltage V is reduced during a time 'tf'. −β immediately after the voltage reduction is started will be referred to as −β1, and −β immediately before the voltage reduction is ended will be referred to as −βk. Further, a time during which β<(Vp/tf) will be referred to as 'tfβ'.

The low-impedance outputting means B shown in FIG. 5 outputs the voltage waveform generated by the waveform generating means A to a plurality of piezoelectric elements P of the ink-jet head H. A selecting means C shown in FIG. 5 supplies a signal to the plurality of piezoelectric elements P of the ink-jet head H and thus selects appropriate ones.

The waveform generating means A may be made from a ROM, a D-A converter or another waveform modifying circuit such as a pulse generating circuit, a differential and integral circuit, a clipping circuit, a clamping circuit and so forth. The low-impedance outputting means B is made of a low-impedance amplifier made from a buffer amplifier, a SEPP (Single-Ended Push-Pull) circuit and so forth. The selecting circuit C is made from a shift register circuit, a latch circuit, and transistors together with diode arrays provided for the respective piezoelectric elements P of the ink-jet head H. A nozzle and a liquid chamber accompany each piezoelectric element P in the ink-jet head H, a set of the nozzle, liquid chamber and piezoelectric element P is referred to a channel. A shape of the piezoelectric element P is changed according to the driving voltage applied to the piezoelectric element P, a pressure is thus applied to the liquid chamber, and ink contained in the liquid chamber is fired via the nozzle as mentioned above. By inserting the low-impedance outputting means B between the waveform generating means A and the plurality of piezoelectric elements P of the ink-jet head H, a low-impedance output of the driving-voltage waveform is supplied to the piezoelectric elements P of the ink-jet head H. As a result, the driving-voltage waveform supplied to the piezoelectric elements is prevented from differing among the piezoelectric elements. Further, the driving-voltage waveform is prevented from being distorted due to differing of a number of the channels to be simultaneously driven by the driving voltage.

Figure 6:
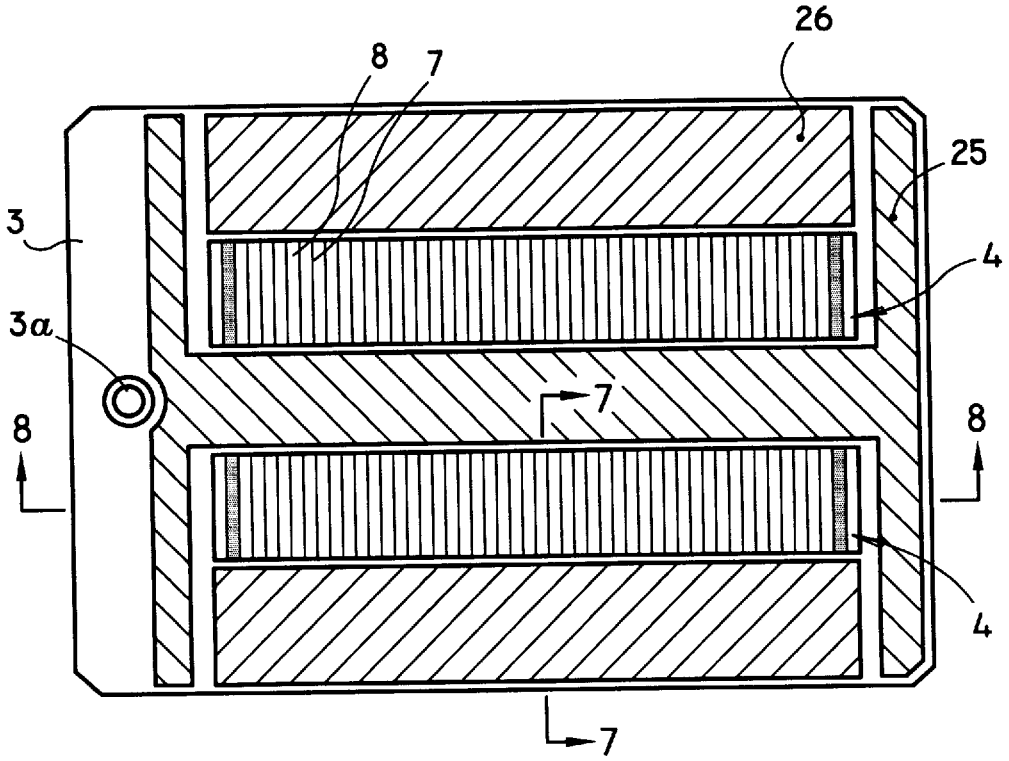
FIG. 6 shows a plan view of an ink-jet head shown in FIG. 4 in a state in which a liquid-chamber unit has been removed therefrom.
Figure 7:
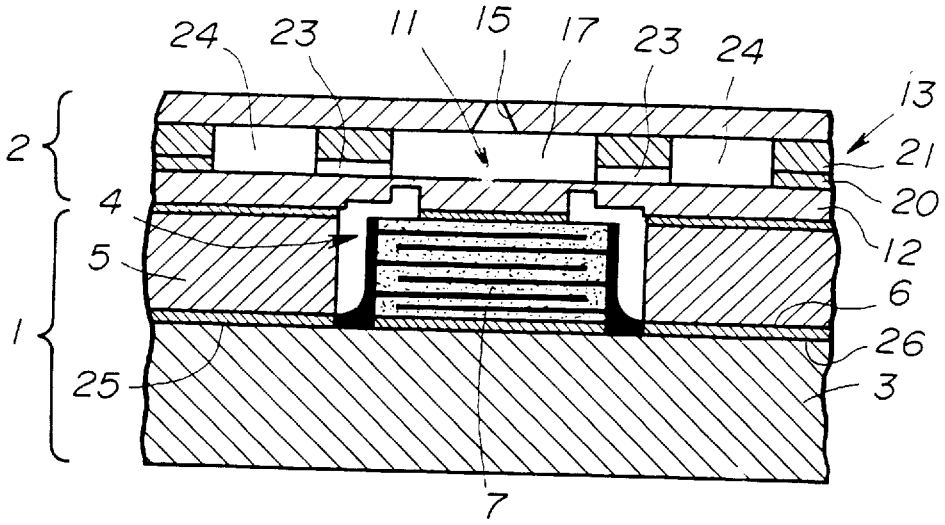
FIG. 7 shows an elevational sectional view of the ink-jet head including the liquid-chamber unit viewed along a A—A line shown in FIG. 6.

As shown in FIG. 7, the ink-jet head H includes an actuator unit 1 and a liquid-chamber unit 2 bonded to the top of the actuator unit 1. The actuator unit 1 includes a substrate 3 made from ceramic, glass epoxy resin and so forth. Further, as shown in FIG. 6, in the actuator unit 1, two rows 4 of laminated piezoelectric elements are fixed on the substrate 3 via a bonding agent 6. Further, frame members 5 are also fixed on the substrate 3 via the bonding agent 6 and surround the two rows 4 of piezoelectric elements.

Figure 8:
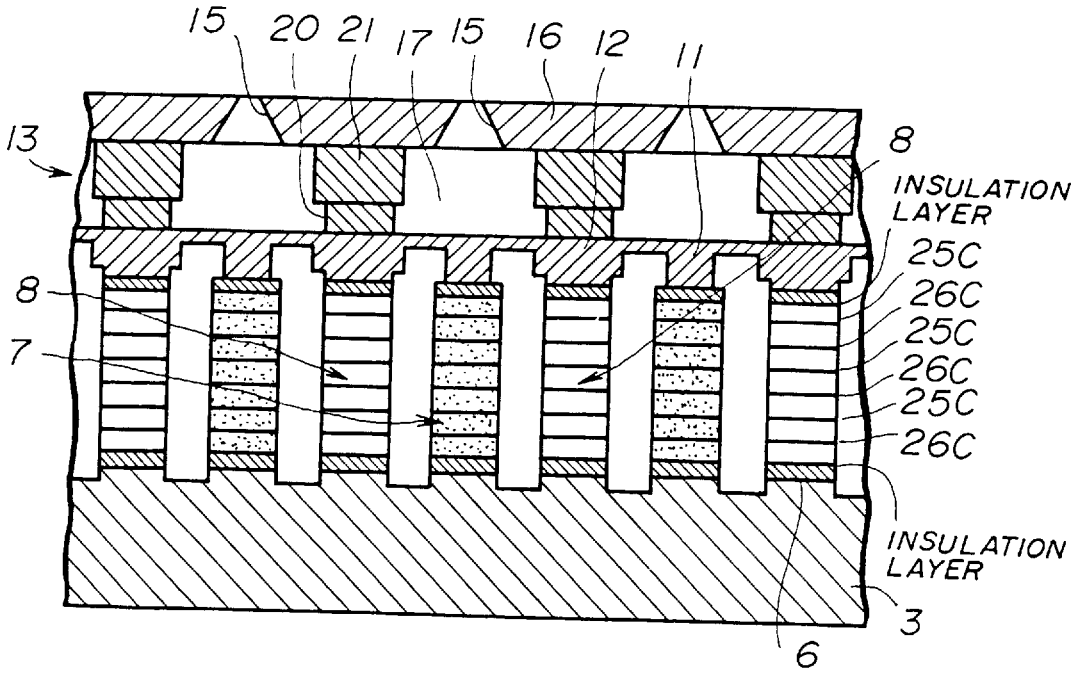
FIG. 8 shows an elevational sectional view of the ink-jet head including the liquid-chamber unit viewed along a B—B line shown in FIG. 6.

As shown in FIG. 8, each row 4 of piezoelectric elements includes a plurality of piezoelectric elements 7. Driving pulses are supplied to the piezoelectric elements 7, a pressure is thus applied to ink in a relevant liquid chamber 17 and thus an ink drop is fired from the liquid chamber 17. The piezoelectric element 7 is referred to as a 'driving piezoelectric element'. As shown in FIG. 8, each row 4 of piezoelectric elements also includes a plurality of piezoelectric elements 8, each being inserted between adjacent ones of the driving piezoelectric elements 7. The piezoelectric elements 8 are ones to which no driving pulses are supplied, merely act as members supporting the liquid-chamber unit 2, and are thus referred to as 'supporting piezoelectric members'. Such an alternate arrangement will be referred to as a 'bi-pitch' arrangement.

As shown in FIGS. 7 and 8, the liquid-chamber unit 2 includes a vibration plate 12 forming a diaphragm unit and a liquid-chamber flowing-path forming member 13 adhered onto the vibration plate 12. The liquid-chamber flowing-path forming member 13 includes two sheets of photosensitive resin films (dry film resist) 20 and 21 which form the liquid chambers 17, common liquid chambers 24 and so forth. Further, as shown in FIG. 8, a nozzle plate 16 is adhered on the liquid-chamber flowing-path forming member 13. The nozzle plate 16 forms a plurality of nozzles 15.

By placement of the vibration plate 12, liquid-chamber flowing-path forming member 13 and nozzle plate 16, a plurality of liquid chambers 17 to which pressure is applied, fluid resistance parts 23 and the common liquid chambers 24 are formed. Each of the plurality of liquid chambers 17 is approximately independent and has a relevant diaphragm unit 11 facing a relevant driving piezoelectric element 7. Further, each liquid chamber 17 has two fluid resistance parts 23 at the two sides, and, as shown in FIG. 7, two common liquid chambers 24 are located outside the two fluid resistance parts 23.

As shown in FIG. 6, on the substrate 3 of the actuator unit 1, a common conductor pattern 25 is provided inside the two rows 4 of piezoelectric elements. Positive terminal electric conductors 25C of all the piezoelectric elements P (the driving piezoelectric elements 7 and supporting piezoelectric elements 8), shown in FIG. 8, are connected to the common conductor pattern 25. Further, an output terminal of the low-impedance outputting means B, provided in a printing apparatus body, is connected to the common conductor pattern 25, to which the pattern 25 the driving voltage is applied. Thereby, it is possible to reduce a number of electric wires connected between the printing apparatus body and the ink-jet head H.

Further, a selecting conductor pattern 26 is provided outside the two rows 4 of the piezoelectric elements as shown in FIG. 6. The selecting conductor pattern 26 includes a plurality of separate conductors, each connected to a respective one of negative terminal electric conductors 26C of the piezoelectric elements P shown in FIG. 8. As a result of inputting the signal from the selecting means C shown in FIG. 5 to the selecting conductor pattern 26, appropriate ones to be driven are selected from the piezoelectric elements P. At this time, only the driving piezoelectric elements 7 can be selected.

The shift register circuit, latch circuit, and transistors together with diode arrays for the respective channels which form the selecting means C are easily formed as one IC chip. This IC chip may be mounted on a portion, a side surface, a front surface, a rear surface or the like of the substrate 3 of the ink-jet head H. Thereby, it is possible to reduce a size of the ink-jet head H. Output terminals of the one IC chip of the selecting means C are connected to selecting terminals of the selecting conductor pattern 26 respectively, and the selecting terminals of the selecting conductor pattern 26 are connected to the plurality of separate conductors for the piezoelectric elements P respectively. An FPC (Flexible Printed Circuit) cable is connected between the selecting means C and the printing apparatus body for supplying input signals, such as latch, clock and enable signals, to the selecting means C. In a case where pitches between the selecting terminals of the selecting conductor patterns approximately correspond to those of the output terminals of the IC chip of the selecting means C, it is possible to directly bond them together using a wire-bonding method, bumps (gold, solder, or the like) or the like.

A waveform of a driving voltage applied to the piezoelectric elements P of the ink-jet head H will now be described.

Figure 9:
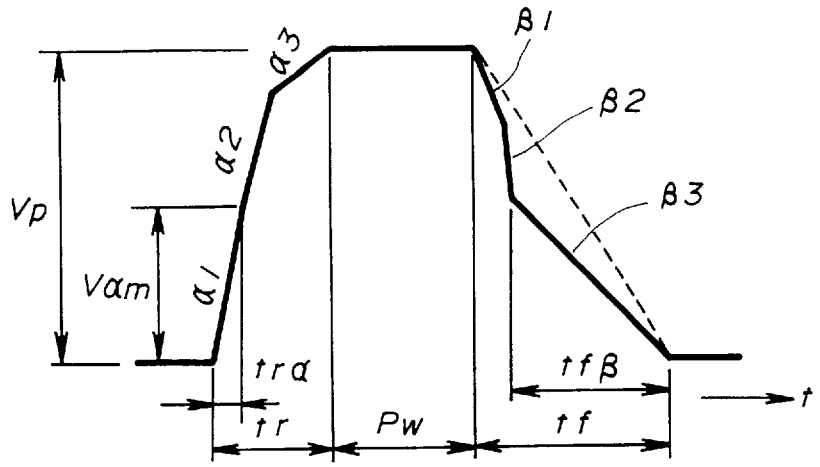
FIG. 9 shows a graph of a driving voltage waveform according to the first embodiment of the present invention.

An experiment is performed where a waveform shown in FIG. 9 is used as a waveform of a driving voltage applied to the piezoelectric elements P of the ink-jet head H. A first embodiment of the present invention includes the waveform generating means A which generates the waveform shown in FIG. 9. As shown in FIG. 9, this waveform has a pulse span Pw where the driving voltage is maintained at a peak voltage Vp. Further, in the waveform, when a pressure of ink is increased, that is, when the driving voltage V is increased, a driving-voltage per-time gradient $\alpha$ ($\Delta V/\Delta t$) is $\alpha$1, $\alpha$2 and $\alpha$3. Thereamong, the maximum one $\alpha m$ is $\alpha$1, and the minimum one $\alpha n$ is $\alpha$3. Further, a voltage increase amount during a time the maximum gradient $\alpha m$ is maintained is $V\alpha m$.

Figure 10:
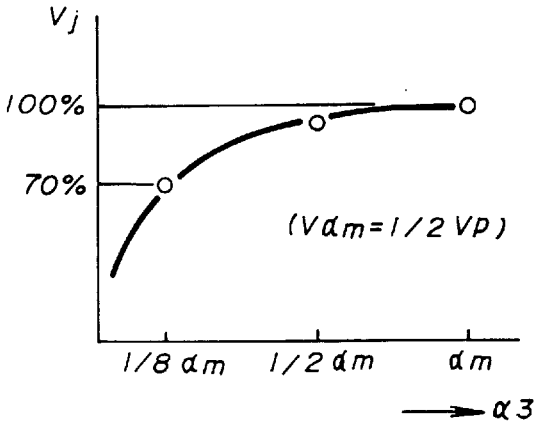
FIG. 10 shows a graph of an example showing a relationship between a gradient of an applied voltage and an ink firing velocity when the waveform shown in FIG. 9 is used.

An experiment is performed where, under a condition where $V\alpha m=(1/2)*Vp$, the minimum gradient $\alpha n$ (=$\alpha$3) is varied with respect to the maximum gradient $\alpha m$ (=$\alpha$1). Thus a resulting variation of an ink-drop firing velocity Vj is measured. As a result, as shown in FIG. 10, if the minimum gradient $\alpha n$ is smaller than ⅛ the maximum gradient $\alpha m$, the ink-drop firing velocity Vj decays sharply. By this result, the driving-voltage per-time gradient $\alpha$ when the driving voltage is increased may fulfill a condition according to the following expression (1):

$$\alpha n \geqq (1/8)*\alpha m \quad (1).$$

Thus, it is possible to maintain a reduction of the ink-drop firing velocity Vj within 30% in comparison to a case where the driving-voltage per-time gradient $\alpha$ is constant during a time the driving voltage V is increased to the peak voltage Vp, that is, $\alpha m=\alpha n$.

Figure 11:
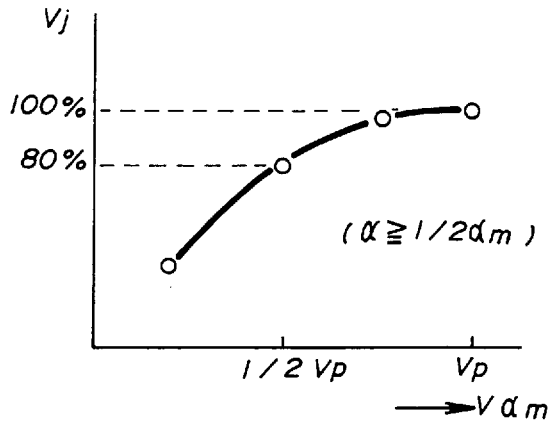
FIG. 11 shows a graph of an example showing a relationship between a voltage increase amount of a maximum value of a gradient of an applied voltage and an ink firing velocity when the waveform shown in FIG. 9 is used.

Another experiment is performed where, under a condition where $\alpha \geqq (1/2)*\alpha m$, the voltage increase amount $V\alpha m$ increasing during a time the maximum gradient $\alpha m$ is maintained is varied with respect to the peak voltage Vp. Thus, a resulting variation of the ink-drop firing velocity Vj is measured. As a result, as shown in FIG. 11, if the voltage increase amount $V\alpha m$ is smaller than ½ the peak voltage Vp, the ink-drop firing velocity Vj decays sharply. By this result, a waveform of the voltage increase may fulfill the following expression (2):

$$V\alpha m \geqq (1/2)*Vp \quad (2).$$

Thus, it is possible to maintain a reduction of the ink-drop firing velocity Vj within 20% in comparison to a case where the driving-voltage per-time gradient α is constant during a time the driving voltage V is increased to the peak voltage Vp, that is, Vαm=Vp.

Thus, by fulfilling the above expressions (1) or (2) when increasing the driving voltage, it is possible to maintain a reduction of the ink-drop firing velocity Vj within a permissible range in comparison to a case where the driving-voltage per-time gradient α is constant during a time the driving voltage V is increased to the peak voltage Vp, even through the driving-voltage per-time gradient α is smaller immediately before the end of the driving voltage increase as shown in FIG. 9. By making the gradient α smaller immediately before the end of the voltage increase, it is possible to reduce the above-mentioned problematic higher-harmonic components which are included in the driving signal.

Further, in the waveform shown in FIG. 9, when a pressure of ink is decreased, that is, when the driving voltage V is decreased, a driving-voltage per-time gradient −β (−ΔV/Δt) is −β1, −β2 and −β3. Thereamong, the gradient −β immediately after the start of the voltage decrease is −β1 and the gradient −βk immediately before the end of the voltage decrease is −β3. As mentioned above, a time during which β<(Vp/tf) will be referred to as 'tfβ' and a time during which the driving voltage V is decreased is 'tf' as shown in FIG. 9. The waveform fulfills the following expressions (3) and (4):

$$\beta 1 > (Vp/tf) > \beta k \quad (3);$$

and $$tf\beta 1 \geqq (1/2)*tf \quad (4).$$

As a result, immediately after the start of the voltage decrease, in comparison to a case where the voltage is decreased linearly with the constant gradient of −Vp/tf, the gradient −β1 is sharper. As a result, a large vacuum pressure is generated in the liquid chamber and thus it is possible to prevent the above-mentioned unnecessary satellites from occurring after the ink drop has been fired. Further, the gradient β is smaller, during a time longer than ½ the entirety of the voltage decrease time tf, than that in the case where the voltage is decreased linearly with the constant gradient of −Vp/tf according to the above expression (4). As a result, it is possible to effectively reduce the above-mentioned problematic pressure wave remaining in the liquid chamber after the voltage decrease has been completed. If tfβ<(½)*tf, the pressure wave may not be reduced and thus a remaining pressure wave may cause an unnecessary satellite if a driving frequency is high.

Thus, the driving waveform fulfills the condition according to at least one of the expressions (1) and (2) when increasing the driving voltage and also fulfills the conditions according to the expressions (3) and (4) when decreasing the driving voltage. The driving voltage having this waveform is applied to the piezoelectric elements. Thereby, it is possible to improve a frequency response of the ink-jet head and thus high frequency driving of the ink-jet head can be performed. Further, it is simultaneously possible to maintain reduction of the ink-drop firing velocity Vj within a permissible range and thus printing quality can be maintained.

Other waveforms, each of which can also fulfill similar conditions, will now be described with reference to FIGS. 12, 13 and 14. Each of second, third, and fourth embodiments of the present invention includes the waveform generating means A which generates the waveform shown in a respective one of FIGS. 12, 13 and 14.

Figure 12:
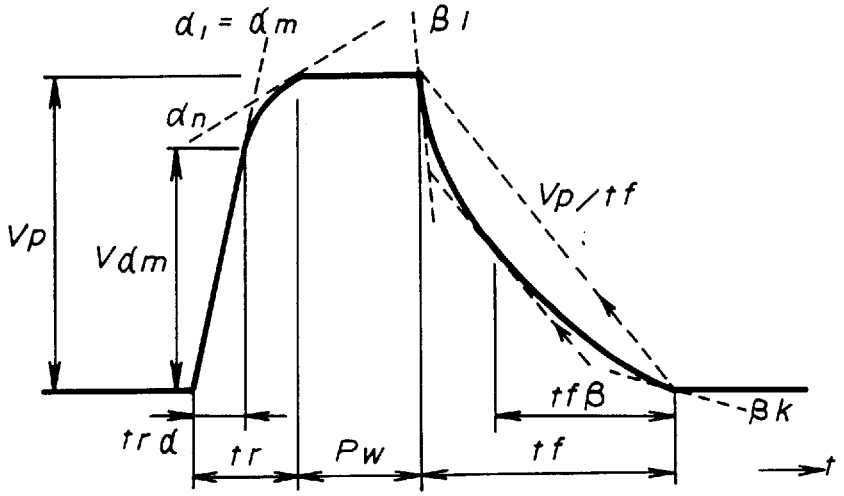
FIG. 12 shows a graph of a driving voltage waveform in the second embodiment of the present invention.

In the waveform shown in FIG. 12, when the voltage increase is started, the driving-voltage per-time gradient α is the maximum gradient αm. Then, immediately before the driving voltage V reaches the peak voltage Vp, the gradient α is the minimum gradient αn. When the voltage is decreased, the gradient β varies gradually as shown in the figure. Further, the driving voltage V is maintained at the peak voltage Vp during a time Pw.

Figure 13:
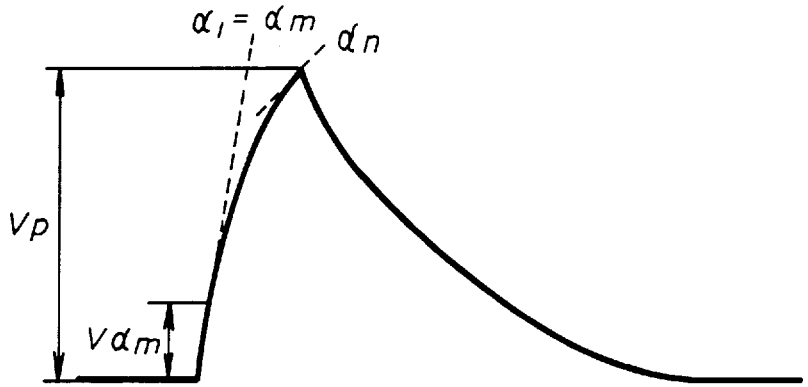
FIG. 13 shows a graph of a driving voltage waveform in the third embodiment of the present invention.

In the waveform shown in FIG. 13, similarly, when the voltage increase is started, the driving-voltage per-time gradient α is the maximum gradient αm. Then, immediately before the driving voltage V reaches the peak voltage Vp, the gradient α is the minimum gradient αn. When the voltage is decreased, the gradient β varies gradually as shown in the figure. However, the voltage decrease is started immediately after the voltage increase has ended as shown in the figure.

Figure 14:
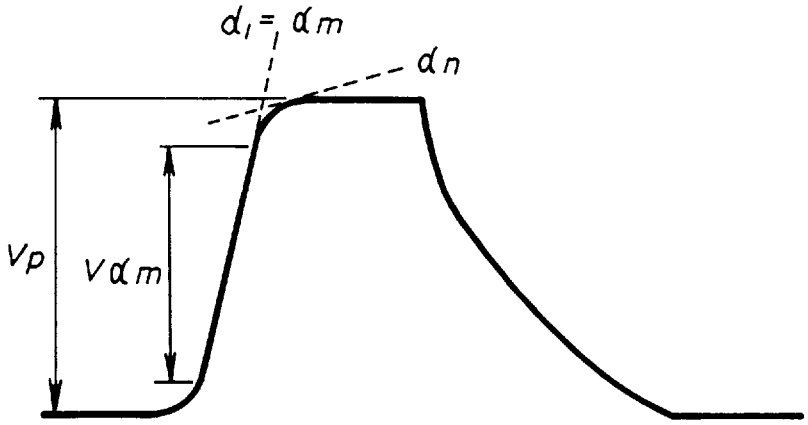
FIG. 14 shows a graph of a driving voltage waveform in the fourth embodiment of the present invention.

In the waveform shown in FIG. 14, the gradient α is the maximum gradient αm after a predetermined time has elapsed, and is the minimum gradient αn immediately before the driving voltage V reaches the peak voltage Vp. When the voltage is decreased, the gradient β varies gradually as shown in the figure. Further, the driving voltage V is maintained at the peak voltage Vp during a time Pw.

Further, a specific circuit of the waveform generating means A and low-impedance outputting means B shown in FIG. 5, which a fifth embodiment of the present invention includes, will now be described with reference to FIG. 15. This circuit is a constant-voltage driving circuit, and generates and outputs a driving voltage having a waveform shown in FIG. 16.

Figure 15:
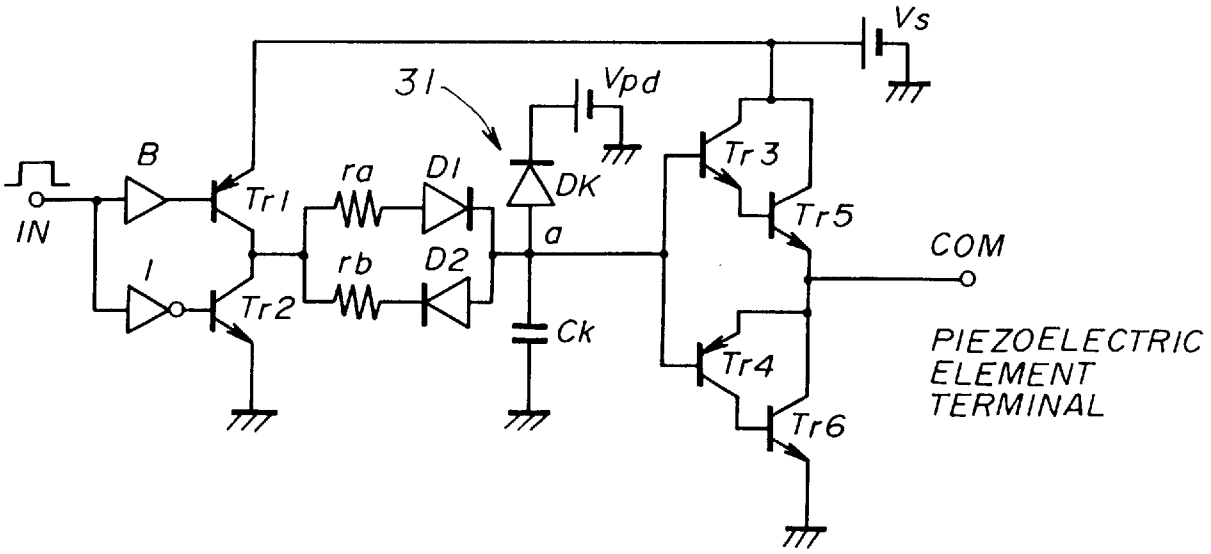
FIG. 15 shows a driving circuit in the fifth embodiment of the present invention.

In this constant-voltage driving circuit shown in FIG. 15, an input terminal, to which an input signal is supplied, is connected to a base of a transistor Tr1 via a buffer B and to a base of a transistor Tr2 via an inverter I. A first power source voltage Vs is supplied to an emitter of the transistor Tr1 and an emitter of the transistor Tr2 is grounded.

Each of collectors of the transistors Tr1 and Tr2 is connected together to a parallel circuit of a series circuit of a resistor ra and a diode D1 and another series circuit of a resistor rb and a diode D2. A cathode of the diode D1 and an anode of the diode D2 are together connected to a point a. A capacitor Ck is connected between the point a and the ground. The resistor ra and capacitor Ck form a time constant circuit used when the driving voltage is increased and the resistor rb and capacitor Ck form a time constant circuit used when the driving voltage is decreased. Further, a second power source voltage Vpd (Vpd<Vs) is supplied to the point a via a diode Dk which acts as a clipping circuit 31.

Transistors Tr3, Tr4, Tr5 and Tr6 form a low-impedance circuit and bases of transistors Tr3 and Tr4 are together connected to the point a which acts as an input terminal of the low-impedance circuit. An emitter of the transistor Tr5 and a collector of the transistor Tr6 are together connected to a common terminal COM of the plurality of piezoelectric elements P of the ink-jet head H.

Figure 16:
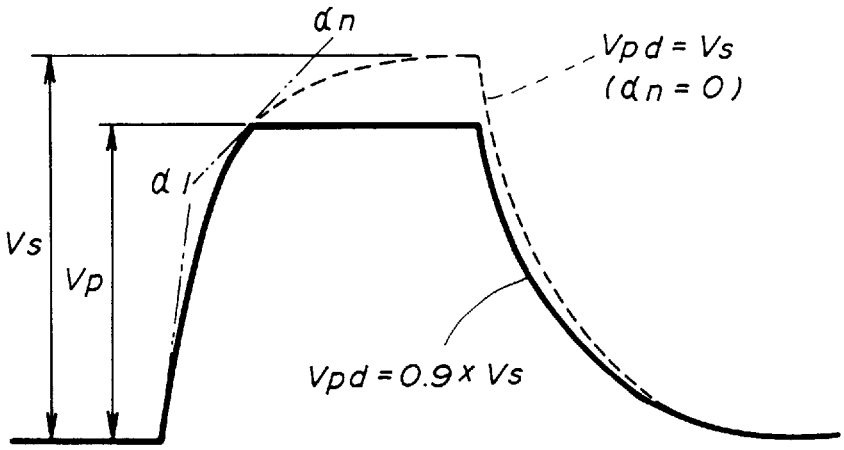
FIG. 16 shows a graph of a driving voltage waveform when the circuit shown in FIG. 15 is used.

In the above-described constant-voltage driving circuit shown in FIG. 15, when a pulse signal of a square wave is input to the input terminal IN, the transistor Tr1 is in an ON state via the buffer B, and the transistor Tr2 is in an OFF state via the inverter I. By the first power source voltage Vs, the capacitor Ck is changed and thus a voltage at the point a increases gradually with a time constant defined by the resistor ra and capacitor Ck. As a result, a driving voltage at the common terminal COM gradually increases as shown in FIG. 16. Because the second power source voltage Vpd is also supplied to the point a, the driving voltage does not reach the voltage Vs and is clipped at a voltage Vp (Vp=Vpd+Vd). Thus, the voltage Vp is the peak voltage of the driving voltage V as shown in FIG. 16.

After a voltage level of the input signal has become zero, in the voltage-constant driving circuit shown in FIG. 15, the transistor Tr1 is in the OFF state via the buffer B and the transistor Tr2 is in the ON state via the inverter I. As a result, discharging of the capacitor Ck is performed with a time constant defined by the resistor rb and the capacitor Ck and thus the voltage at the point a decreases gradually with a time constant defined by the resistor ra and capacitor Ck. As a result, a driving voltage at the common terminal COM gradually decreases as shown in FIG. 16.

Thus, the waveform shown in FIG. 16 fulfilling the above-mentioned conditions is generated, and the driving voltage of the waveform is applied to the common terminal of the plurality of piezoelectric elements P of the ink-jet head H via the low-impedance circuit from the point a. By appropriately selecting the first and second power source voltages Vs, Vpd, the resistors ra, rb and the capacitor Ck, a desired waveform can be generated easily with low costs.

Figure 17:
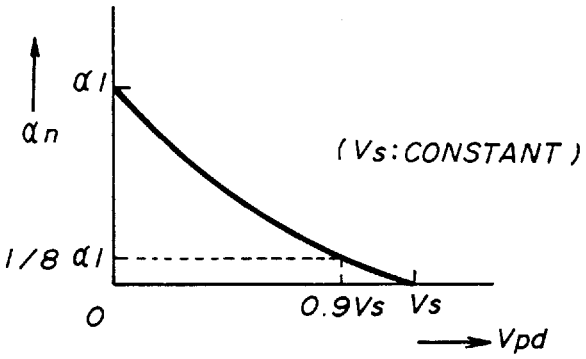
FIG. 17 shows a graph of a relationship between a second power source voltage and a minimum value of a gradient of the driving voltage when the circuit shown in FIG. 15 is used.

With reference to FIG. 17, in the constant-voltage driving circuit shown in FIG. 15, if the second power source voltage Vpd is varied with respect to the first power source voltage Vs, as the second power source voltage Vpd is made increasingly smaller with respect to the first power source voltage Vs, the minimum gradient an becomes sharper. By setting the second power source voltage Vpd and thus the peak driving voltage Vp such that $Vp<0.9*Vs$, and preferably $Vp\leqq 0.7*Vs$, $\alpha n>(1/8)*\alpha m$ (where $\alpha m=\alpha 1$), as shown in FIG. 17. As a result, it is possible to maintain reduction of the ink-drop firing velocity Vj within a permissible range as mentioned above with reference to FIG. 10. Further, the above-mentioned problematic higher-harmonic components which are included in the driving signal can also be reduced as a result of reducing the gradient $\alpha$ immediately before the voltage increase is ended as shown in FIG. 16. As a result, it is possible to drive the ink-jet head at a high frequency.

Figure 1A:
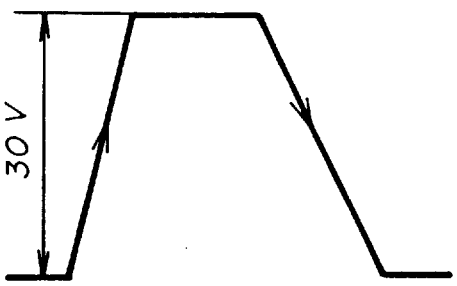
FIG. 1A PRIOR ART
FIGS. 1A and 1B show examples of waveforms of driving signals in the related art.
Figure 1B:
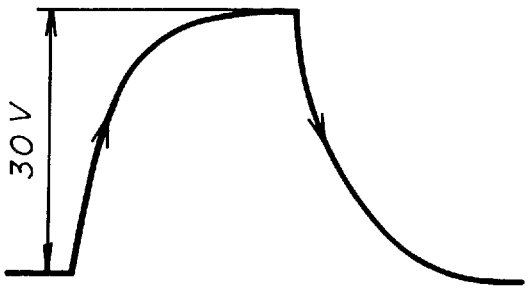
FIG. 1B PRIOR ART
Figure 2:
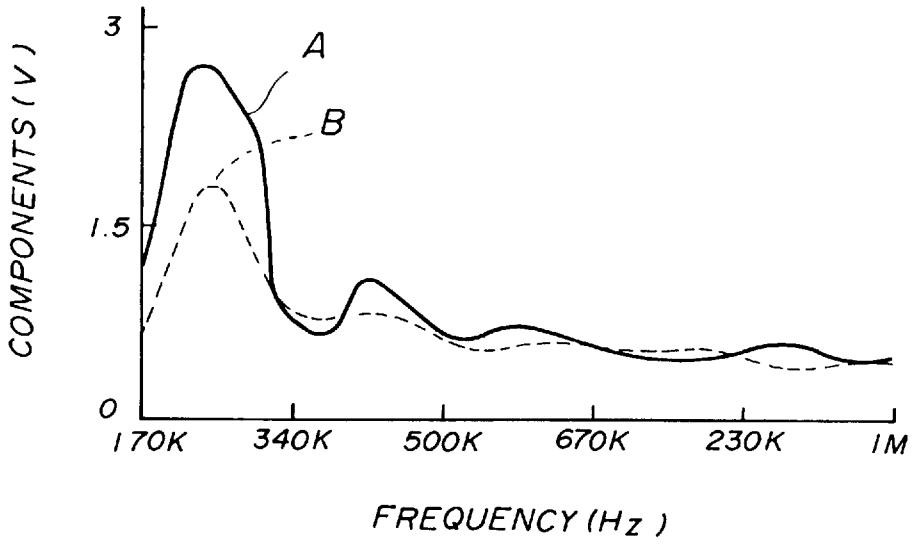
FIG. 2 PRIOR ART
FIG. 2 shows a graph of higher-harmonic components included in the driving signals of the waveforms shown in FIGS. 1A and 1B.

If the second power source voltage Vpd is fixed, by setting the first power source voltage Vs at a high level, it is possible to make the minimum gradient $\alpha n$ be larger and thus approach the maximum gradient $\alpha m$. As a result, it is possible to improve the ink-drop firing velocity Vj. If Vs=Vpd, as shown in FIG. 16 by a broken line, $\alpha n=0$ and thus the relevant waveform is similar to that shown in FIG. 1B. As a result, the ink-drop firing velocity Vj may be problematically low.

Figure 18:
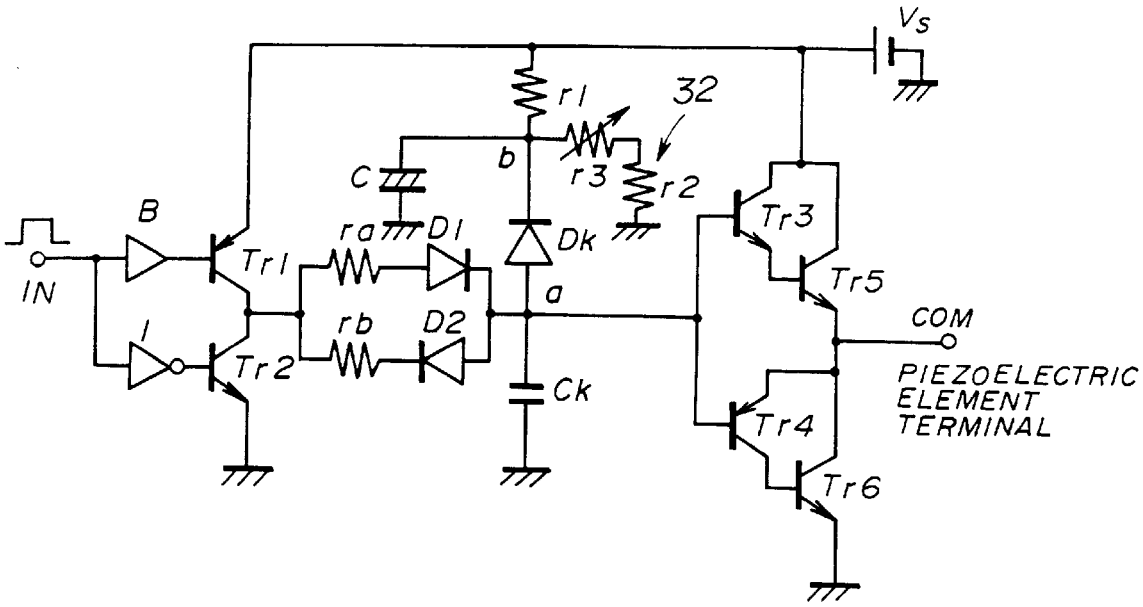
FIG. 18 shows a driving circuit in the sixth embodiment of the present invention.
Figure 19:
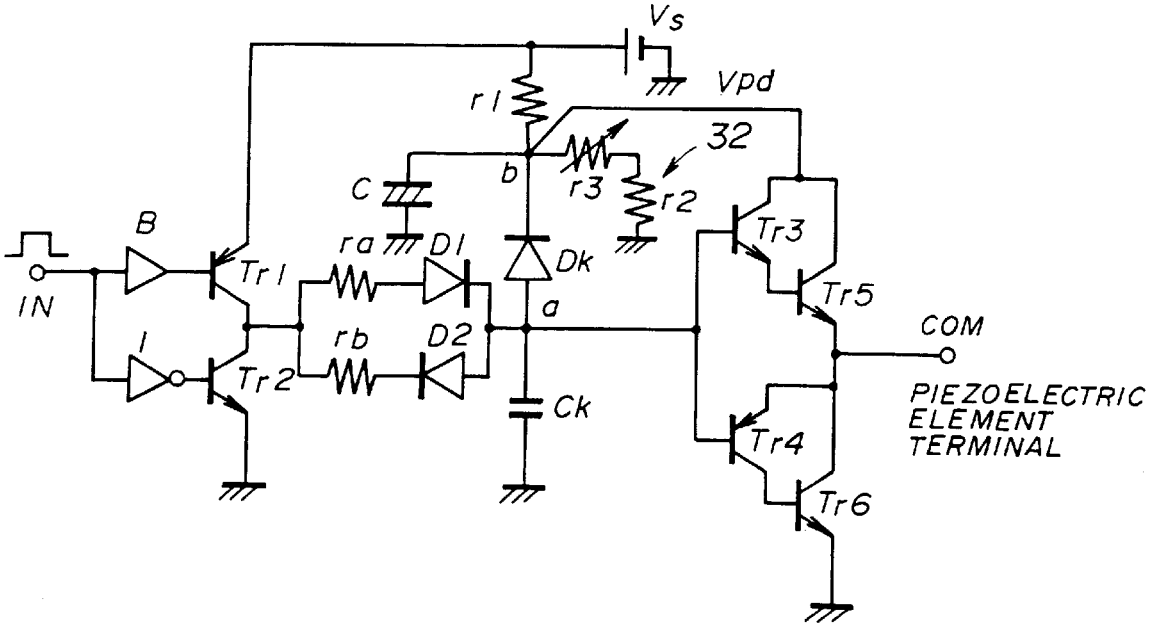
FIG. 19 shows a driving circuit in the seventh embodiment of the present invention.
Figure 20:
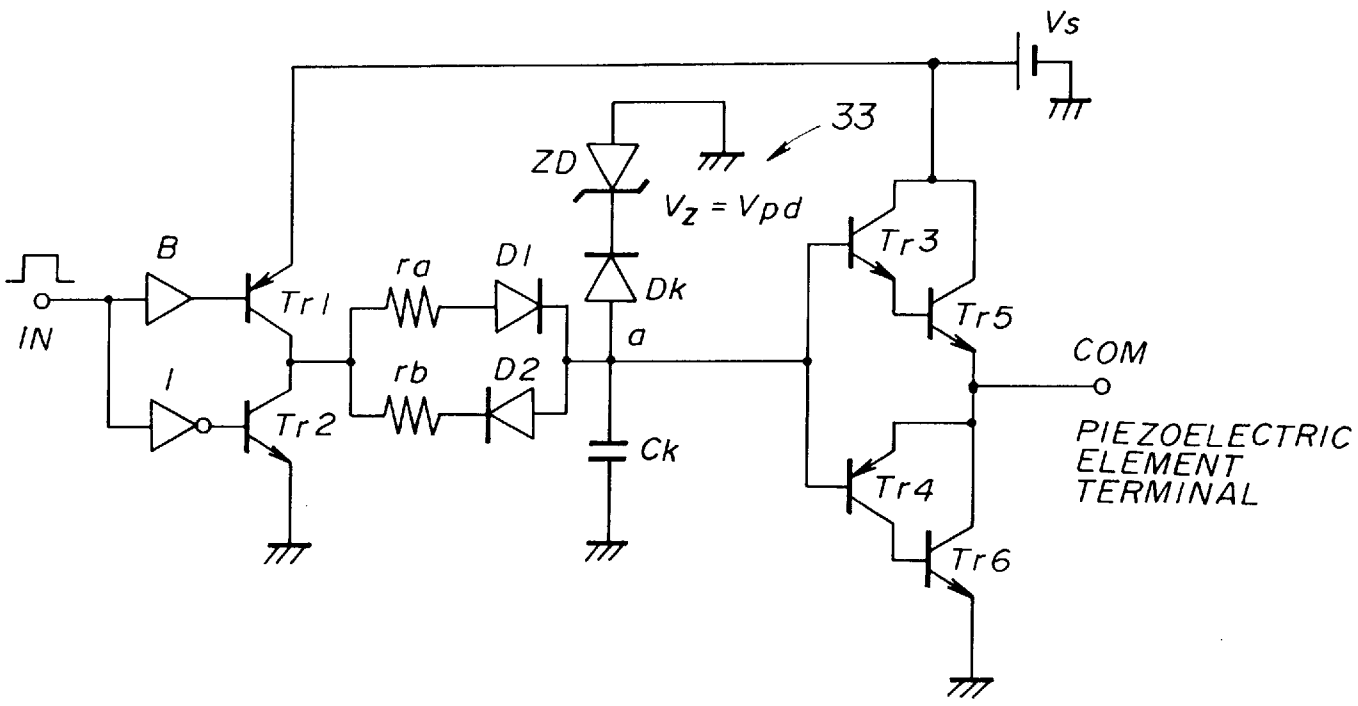
FIG. 20 shows a driving circuit in the eighth embodiment of the present invention.

With reference to FIGS. 18, 19 and 20, a sixth, seventh and eighth embodiments of the present invention will now be described.

In the constant-voltage driving circuit shown in FIG. 18, a clipping circuit 32 is provided including resistors r1, r2, a variable resistor r3, the diode Dk and an electric-current compensation electrolytic capacitor C. In this clipping circuit 32, the first power source voltage Vs is distributed according to a ratio of the resistance of the resistor r1 to the resistance of a series circuit of the resistor r2 and variable resistor r3. A thus-distributed voltage appears at a point b and is used as the second power source voltage Vpd. Thereby, the capacitor Ck can be charged until $Vp=Vs*\{(r2+r3)/(r1+r2+r3)\}+Vd$.

Thus, the second power source voltage Vpd is generated from the first power source voltage Vs and thus the constant-voltage driving circuit can be provided with low costs. Further, it is easy to perform driving voltage control such as temperature compensation, correction of a driving voltage difference due to characteristics of particular heads and so forth.

In the constant-voltage driving circuit shown in FIG. 19, the second power source voltage Vpd gendered through the above-mentioned clipping circuit 32 is supplied as a power source voltage of a low-impedance outputting stage. As a result, it is possible to reduce a transistor loss in the low impedance circuit but it is necessary to use the electrolytic capacitor C having a larger capacitance than that used in the circuit shown in FIG. 18.

In the constant-voltage driving circuit shown in FIG. 20, a clipping circuit 33 including a Zener diode ZD and the diode Dk is provided. In this circuit, a Zener voltage Vz of the Zener diode ZD is the second power source voltage Vpd (Vz=Vpd), and therefore the peak driving voltage Vp applied to the piezoelectric elements depends on the Zener voltage Vz. Therefore, if the peak driving voltage is controlled for a difference in characteristics among particular heads, a plurality of Zener diodes ZD having different Zener voltage Vz may be provided and an appropriate one may be selected therefrom.

Thus, by providing the second power source voltage Vpd from the first power source voltage Vs using the Zener diode ZD, it is possible to provide the constant-voltage driving circuit with low costs and a reduced space for the circuit.

In the description of the structure of the ink-jet head with reference to FIGS. 6, 7 and 8, the present invention is applied to the ink-jet head of a side shooter system in which a nozzle opening direction is concentric with a piezoelectric-element transformation direction. However, the present invention can also be applied to an ink-jet head of a edge shooter system in which the nozzle opening direction is perpendicular to the piezoelectric-element transformation direction.

Further, in the above description, the present invention is applied to the ink-jet head in which the driving piezoelectric elements 7 and supporting piezoelectric elements 8 are alternately arranged and thus in the bi-pitch structure. However, the present invention can also be applied to an ink-jet head in which all of the piezoelectric elements are the driving piezoelectric elements and thus in a normal pitch structure. In the normal pitch structure, the supporting piezoelectric elements 8 in the above description are replaced by the driving piezoelectric elements.

Figure 21:
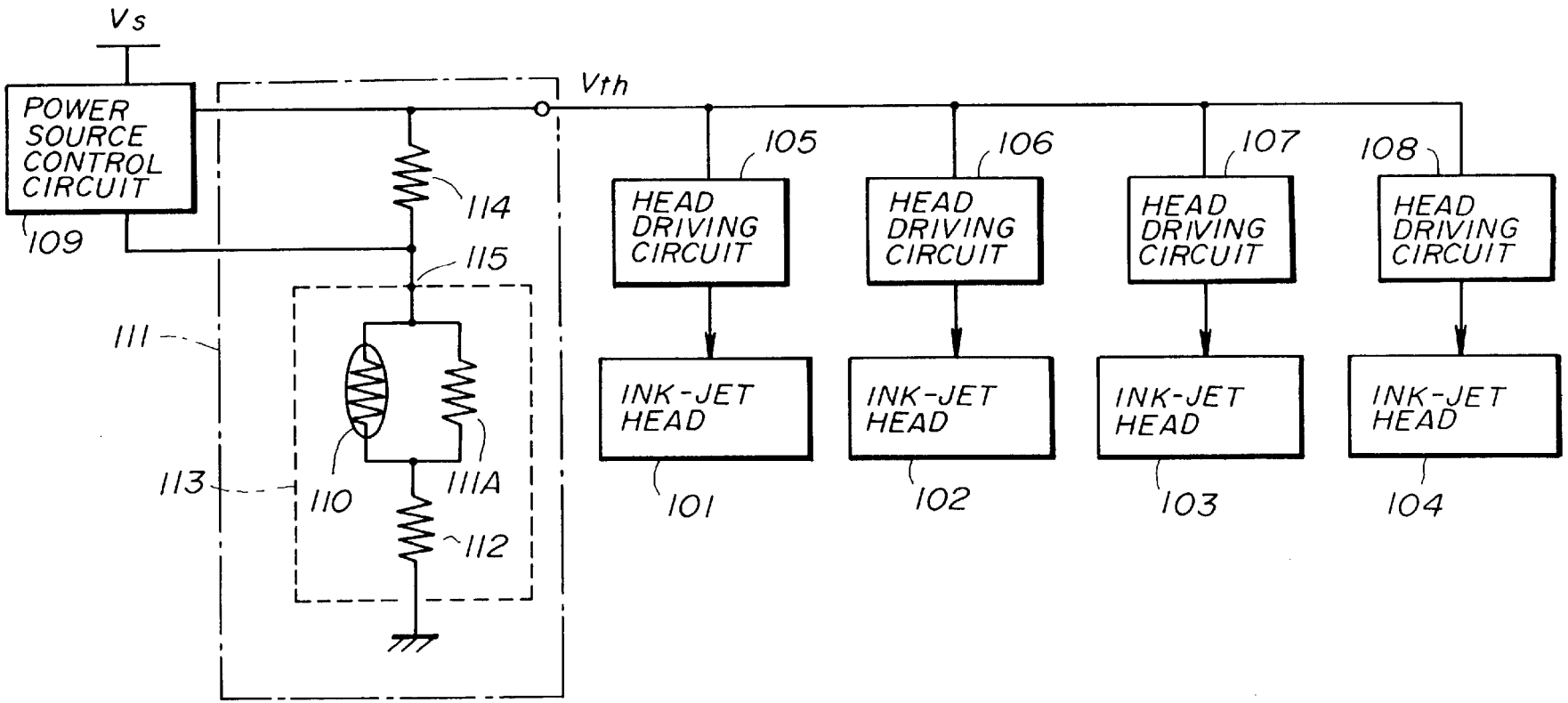
FIG. 21 shows a ninth embodiment of the present invention.

With reference to FIG. 21, an ink-jet printing apparatus in a ninth embodiment of the present invention will now be described.

In ink-jet printing apparatus in the ninth embodiment, a plurality of (actually, four) ink-jet heads 101, 102, 103 and 104 are provided. Each ink-jet head has, for example, a plurality of nozzles which fire ink drops and a plurality of actuators and so forth which are relevant to the plurality of nozzles respectively and each of which includes an electromechanical transducer such as the piezoelectric element or the like or heating resistance element such as a heater or the like. By selectively driving the plurality of actuators, an image is printed on a recording sheet material such as a recording paper.

Further, in the ink-jet printing apparatus, a plurality of head driving circuits 105, 106, 107 and 108 are provided and drive the plurality of ink-jet heads 101, 102, 103 and 104 respectively. Further, a power source control circuit 109 for commonly supplying power source voltage to the respective head driving circuits 105, 106, 107 and 108. Further the ink-jet printing apparatus includes a thermistor 110 which detects an ambient temperature and a resistor voltage-distributing circuit 111 which adjusts the power source voltage Vth commonly supplied to the head driving circuits 105, 106, 107 and 108 according to the ambient temperature detected through the thermistor 110.

The power source control circuit 109 may be provided using a three-terminal regulator on the market such as LM317 (a trade name of National Semiconductor), TL783C (a trade name of Texas Instruments) or the like. Further, as shown in FIG. 21, the resistor voltage-distributing circuit 111 includes a resistor 114 and a series circuit 113 of a resistor 112 and a parallel circuit of a resistor 111A and the thermistor 110. A terminal of the resistor voltage-distributing circuit 111 is connected to an output terminal of the power source control circuit 109 and the other terminal of the circuit 111 is grounded. Further, a voltage distributing point 115 is connected to the other terminal of the power source control circuit 109. A specific example of each of the head driving circuits 105, 106, 107 and 108 will be described later.

In an above-described ink-jet head driving circuit shown in FIG. 21, the power source voltage Vth commonly supplied by the three-terminal regulator of the power source control circuit 109 to the respective head driving circuits 105, 106, 107 and 108 is obtained by the following expression (5):

$$Vth=1.25*(1+R2/R1) \quad (5).$$

In the above expression, R1 is a resistance of the resistor 114 in the resistor voltage-distributing circuit 111, and R2 is an integral resistance of the series circuit 113.

The integral resistance R2 of the series circuit 113 is obtained by the following expression (6):

$$R2=Rth*Rp/(Rth+Rp)+Rs \quad (6).$$

In the above expression, Rth is a resistance of the thermistor 110, Rp is a resistance of the resistor 111A and Rs is a resistance of the resistor 112.

Figure 22:
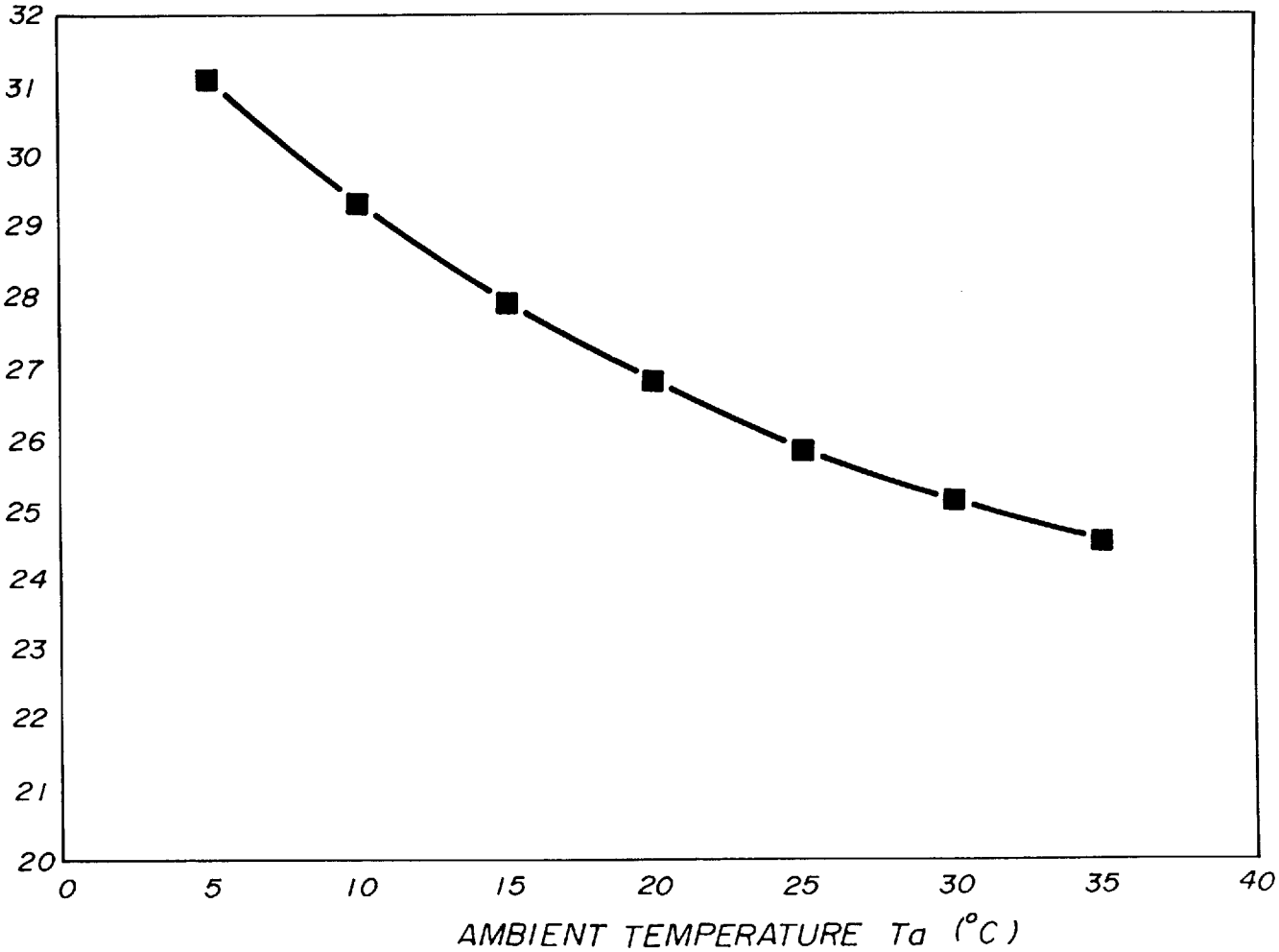
FIG. 22 shows a graph, for illustrating the ninth embodiment, indicating an example of a relationship between an ambient temperature and a power source voltage Vth.

When an ambient temperature falls, the resistance Rth of the thermistor 110 increases and thus the resistance R2 in the expression (6) increases. As a result, the power source voltage Vth supplied to the head driving circuits 105, 106, 107 and 108 increases. FIG. 22 shows a relationship between the ambient temperature Ta and the power source voltage Vth in a case where as the thermistor 110, 104H (a trade name of SEMITEC) is used; as the power source control circuit 109, the above-mentioned LM317 is used; the resistance R1 of the resistor 114 is 30 kΩ; the resistance Rp of the resistor 111A is 1 MΩ; and the resistance Rs of the resistor 112 is 500 kΩ.

Figure 23:
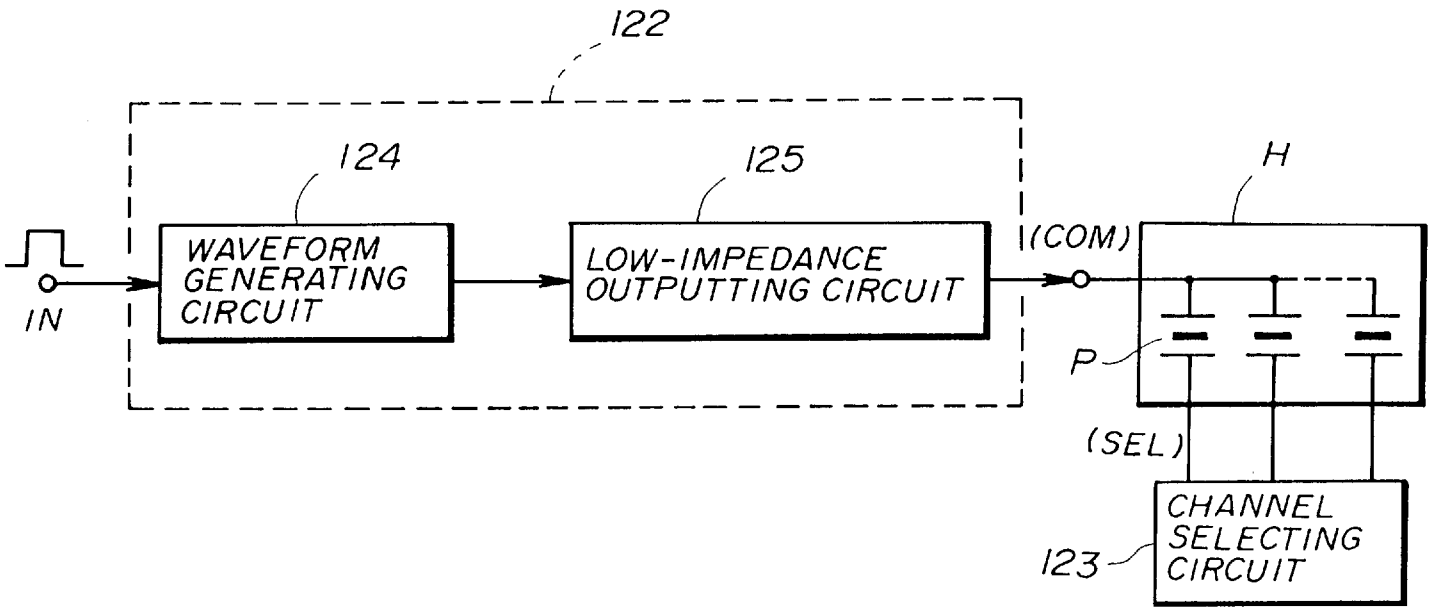
FIG. 23 shows a block diagram of an example of a head driving circuit.

With regard to FIG. 23, each of the head driving circuits 105, 106, 107 and 108 will now be described. The head driving circuit drives an ink-jet head H. The head driving circuit includes a constant-voltage driving circuit 122 including a waveform generating circuit 124 and a low-impedance outputting circuit 125. The waveform generating circuit 124 generates a predetermined waveform of a driving voltage from a square-wave pulse when a predetermined pressure is applied to ink through the actuator and thus ink is fired from the ink-jet head H. The low-impedance outputting circuit 125 shown in FIG. 23 outputs the voltage waveform generated by the waveform generating circuit 124 to a plurality of actuators such as, for example, piezoelectric elements P of the ink-jet head H via a common terminal COM of the ink-jet head H. A channel selecting circuit 123 shown in FIG. 23 supplies a signal to the plurality of piezoelectric elements P of the ink-jet head H via selecting conductors SEL of the ink-jet head H, and thus selects appropriate ones from the plurality of piezoelectric elements P to be driven, according to a given printing signal.

The waveform generating circuit 124 in the constant-voltage driving circuit 122 may be made from a ROM, a D-A converter or another waveform modifying circuit such as a pulse generating circuit, a differential and integral circuit, a clipping circuit, clamping circuit and so forth. The low-impedance outputting circuit 125 is made of a low-impedance amplifier made from a buffer amplifier, a SEPP (Single-Ended Push-Pull) circuit and so forth. The channel selecting circuit 123 is made from a shift register circuit, a latch circuit, and transistors together with diode arrays provided for the respective piezoelectric elements P of the ink-jet head H.

A nozzle and a liquid chamber accompany each piezoelectric element P in the ink-jet head H. A set of the nozzle, liquid chamber and piezoelectric element P is referred to as a channel. A shape of the piezoelectric element P is changed according to the driving voltage applied to the piezoelectric element P, a pressure is thus applied to the liquid chamber, and ink contained in the liquid chamber is fired via the nozzle as mentioned above.

By inserting the low-impedance outputting circuit 125 between the waveform generating circuit 124 and the plurality of piezoelectric elements P of the ink-jet head H, a low-impedance output of the driving-voltage waveform is supplied to the piezoelectric elements P of the ink-jet head H. As a result, the driving-voltage waveform supplied to the piezoelectric elements is prevented from differing among the piezoelectric elements. Further, the driving-voltage waveform is prevented from being distorted due to differing of a number of the channels to be simultaneously driven by the driving voltage.

A specific circuit of the constant-voltage driving circuit 122 will now be described with reference to FIG. 24. In this constant-voltage driving circuit 122 shown in FIG. 24, an input terminal IN, to which an input signal is supplied, is connected to a base of a transistor Tr1 via a buffer B and to a base of a transistor Tr2 via an inverter I. A power source voltage Vs is supplied to an emitter of the transistor Tr1 and an emitter of the transistor Tr2 is grounded.

Each of collectors of the transistors Tr1 and Tr2 is connected together to a parallel circuit of a series circuit of a resistor Ra and a diode D1 and another series circuit of a resistor Rb and a diode D2. A cathode of the diode D1 and an anode of the diode D2 are together connected to a point a. A capacitor Ck is connected between the point a and the ground. The resistor Ra and capacitor Ck form a time constant circuit used when the driving voltage is increased and the resistor Rb and capacitor Ck form a time constant circuit used when the driving voltage is decreased. Further, the (Vth<Vs) voltage Vth (Vth<Vs) is supplied to the point a via a diode Dk.

Transistors Tr3, Tr4, Tr5 and Tr6 form the low-impedance outputting circuit 125 and bases of transistors Tr3 and Tr4 are together connected to the point a which acts as an input terminal of the low-impedance outputting circuit 125. An emitter of the transistor Tr5 and a collector of the transistor Tr6 are together connected to a common terminal COM of the plurality of piezoelectric elements P of the ink-jet head H.

Figure 24:
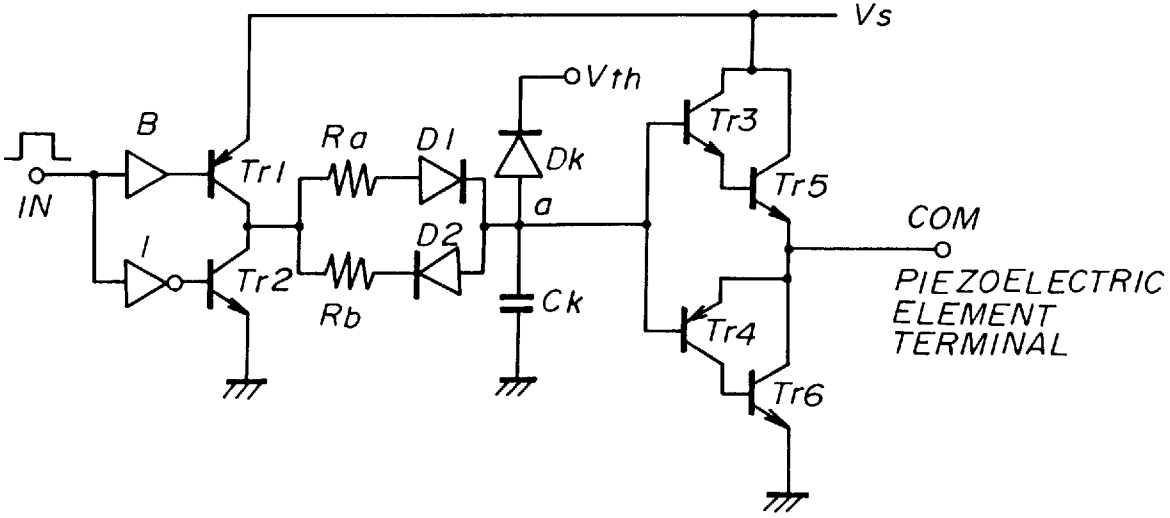
FIG. 24 shows a specific example of a constant-voltage driving circuit in a circuit shown in FIG. 23.

In the above-described constant-voltage driving circuit 122 shown in FIG. 24, when a pulse signal of a square wave is input to the input terminal IN, the transistor Tr1 is in an ON state via the buffer B, and the transistor Tr2 is in an OFF state via the inverter I. By the power source voltage Vs, the capacitor Ck is changed and thus a voltage at the point a increases gradually with a time constant defined by the resistor Ra and capacitor Ck. As a result, a driving voltage V at the common terminal COM gradually increases as shown in FIG. 24. Because the power source voltage Vth is also supplied to the point a via the diode Dk (with a dropping voltage Vd), the driving voltage V does not reach the voltage Vs and is clipped at a voltage Vth' (Vth'=Vth+Vd). Thus, the voltage Vth' is a peak voltage Vp of the driving voltage V as shown in FIG. 25.

After a voltage level of the input signal has become zero, in the constant-voltage driving circuit shown in FIG. 24, the transistor Tr1 is in the OFF state via the buffer B and the transistor Tr2 is in the ON state via the inverter I. As a result, discharging of the capacitor Ck is performed with a time constant defined by the resistor Rb and the capacitor Ck and thus the voltage at the point a decreases gradually with a time constant defined by the resistor Ra and capacitor Ck. As a result, a driving voltage at the common terminal COM gradually decreases from the peak voltage Vp as shown in FIG. 25.

Thus, in this constant-voltage driving circuit 122, a voltage Vth' depending on the power source voltage Vth, which varies according to the ambient temperature as shown in FIG. 22, is used to clip the driving voltage V supplied to the piezoelectric elements P. A resulting waveform of the driving voltage is such that shown in FIG. 25 by a solid curve. If Vth=Vs, a waveform shown in FIG. 25 by a broken line is obtained.

Figure 25:
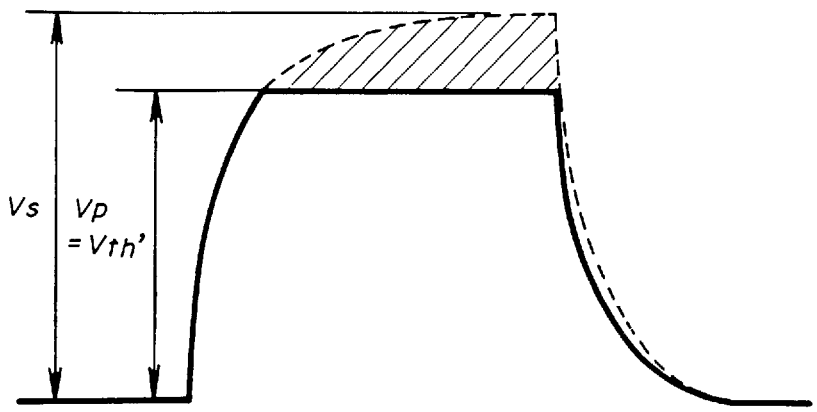
FIG. 25 illustrates a driving voltage waveform output by the constant-voltage driving circuit shown in FIG. 24.

Thus, in this embodiment, a portion (indicated by hatching) of a waveform rising curve in the waveform having a low driving-voltage per-time gradient ($\Delta V/\Delta t$) is clipped as shown in FIG. 25. The waveform rising curve corresponds to a ink-drop firing timing. Thereby, it is possible to prevent an electric energy transducing efficiency relevant to the ink-drop firing velocity Vj and ink firing volume Mj from decaying. Further, in the embodiment, it is possible to fix the ink-drop firing velocity Vj and ink firing volume Mj even if an ambient temperature varies.

Further, a waveform decaying curve is formed so that the driving-voltage per-time gradient is sharp at the beginning of the decaying and becomes gradually gentler thereafter as time passes as shown in FIG. 25. Thereby, it is possible to prevent formation of an unnecessary satellite after ink is fired and reduce higher-harmonic components. Thus, high-speed high-quality image printing can be performed.

In the ninth embodiment of the present invention, the common power source voltage Vth is adjusted by the resistor voltage-distributing circuit 111 including the thermistor 110 thus according to the ambient temperature. As a result, ink-drop firing characteristics of the plurality of ink-jet heads can be commonly adjusted according to the ambient temperature. Changing the ink-drop firing characteristics of the ink-jet heads according to the ambient temperature can improve a printed image quality.

In fact, when the ambient temperature falls, a viscosity of ink increases. As a result, if the ink firing characteristics of the ink-jet heads were not adjusted according to the ambient temperature, the ink-drop firing velocity Vj and ink firing volume Mj may have been reduced due to the increase of the ink viscosity. In this embodiment, the power source voltage Vth increases when the ambient temperature falls as shown in FIG. 22. Thus, such reduction of the ink-drop firing velocity Vj and ink firing volume Mj can be effectively prevented.

Further, because the power source voltage Vth is adjusted commonly for the plurality of ink-jet heads in this embodiment, it is possible to reduce costs of the ink-jet head driving circuit.

Further, as shown in FIG. 22, means for detecting the ambient temperature and thereby adjusting the power source voltage Vth is provided using the resistor voltage-distributing circuit ill with a simple circuit arrangement merely including the thermistor 110 and resistors. Thus, it is possible to reduce costs of the ink-jet head driving circuit.

In the above-described ninth embodiment, only ambient temperature is detected and then used for adjusting the ink firing characteristics of ink-jet heads. However, not only ambient temperature but also various other environmental conditions may cause to unexpectedly vary a state in which dots are formed on a recording sheet material as a result of ink being fired and ink-drop firing characteristics (firing velocity Vj and firing amount Mj). These various other environmental conditions include a kind of recording sheet material used, a time elapsing after power source was supplied, a number of times the heads are driven (printing frequency), and so forth. Therefore, by detecting these environmental conditions and then adjusting, according to the thus-detected environment conditions, the power source voltage Vth commonly supplied to the head driving circuits, a printed-image quality can be further improved.

Figure 26:
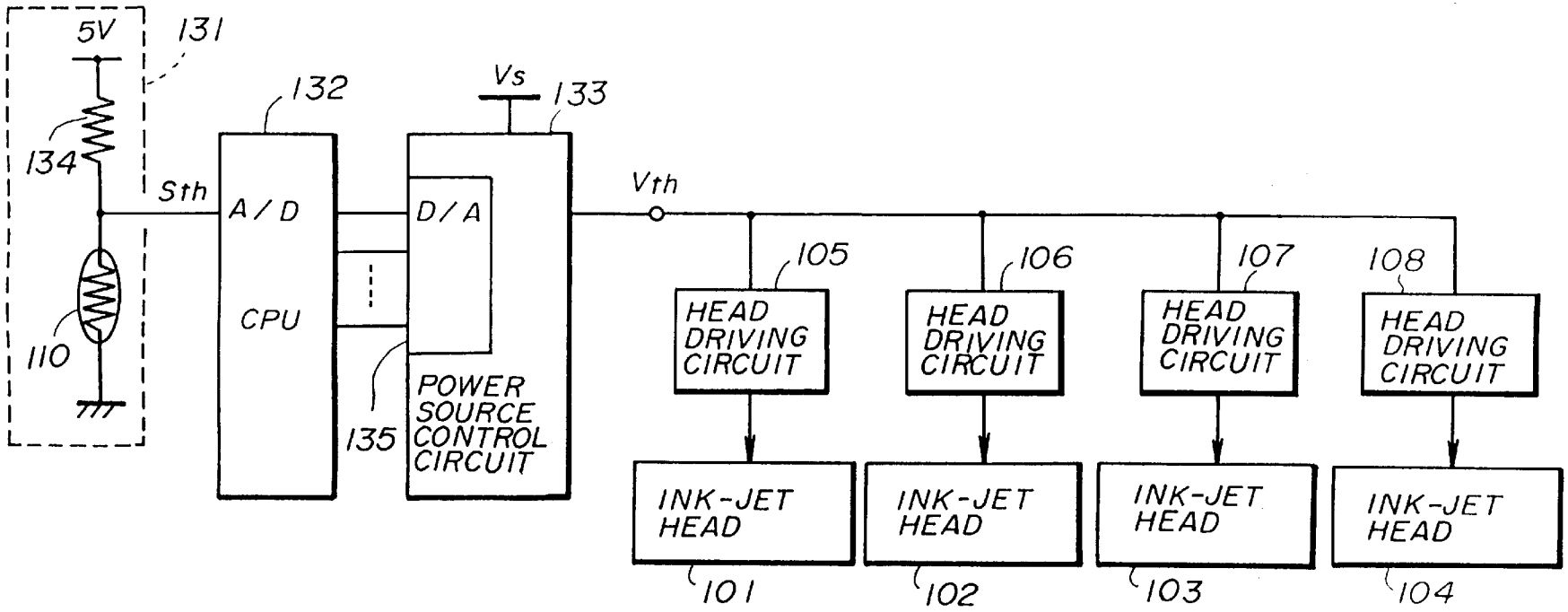
FIG. 26 shows a block diagram of a tenth embodiment of the present invention.

With reference to FIG. 26, an ink-jet head driving circuit in a tenth embodiment will now be described. This ink-jet head driving circuit includes the head driving circuits 105, 106, 107 and 108 similar to those used in the ninth embodiment, a temperature detecting circuit 131, a microcomputer (hereinafter, referred to as CPU) 132, and a power source control circuit 133. The CPU 132 supplies predetermined bit data (bit signal). The predetermined bit data represents the power source voltage Vth which is supplied to the head driving circuits 105, 106, 107 and 108. The predetermined bit data is determined based on a result of temperature detection performed by the temperature detecting circuit 131. The power source control circuit 133 commonly supplies the power source voltage Vth to the head driving circuits 105, 107, 107 and 108.

The temperature detecting circuit 131 includes a thermistor 110 for detecting ambient temperature and a resistor 134 and outputs a detected temperature signal Sth according to a resistance of the thermistor 110. The CPU 132 includes or externally has an analog input terminal and an A-D converter, and converts the detected temperature signal Sth from the temperature detecting circuit 131 into a digital signal such as binary data (bit data) of 8 bits or the like. The thus-obtained bit data is supplied to the power source control circuit 133. The bit data represents a driving voltage (power source voltage Vth) predetermined based on head ink firing characteristics with respect to ambient temperature. The power source control circuit 133 has a D-A converter and converts the bit data supplied by the CPU 132 into an analog signal. The power source control circuit 133 supplies the power source voltage Vth according to the thus-obtained analog signal commonly to the head driving circuits 105, 106, 107 and 108.

In the above-described arrangement, according to variation of the ambient temperature, the resistance of the thermistor 110 varies and accordingly a voltage level of the detected temperature signal Sth changes. The CPU 132 generates the bit data and supplies it to the power source control circuit 133. The bit data is determined based on the voltage level of the detected temperature signal Sth and the ink-drop firing characteristics so that the predetermined optimum power source voltage Vth should be supplied to the head driving circuits 105, 106, 107 and 108.

Thus, in the above-described tenth embodiment, similar to the ninth embodiment, with a simple arrangement, required costs can be reduced and also a printed image quality can be improved. Further it is possible to arbitrarily set a correspondence relationship between the power source voltage and the bit data in the CPU 132. Accordingly, it is possible to further highly accurately adjust the power source voltage supplied to the head driving circuits.

In the above-described tenth embodiment, only ambient temperature is detected and then used for adjusting the ink firing characteristics of ink-jet heads. However, as described above, not only ambient temperature but also various other environmental conditions may unexpectedly vary a state in which dots are formed on a recording sheet material as a result of ink being fired and ink-drop firing characteristics (firing velocity Vj and firing amount Mj). These various other environmental conditions include a kind of recording sheet material used, a time elapsing after power source was supplied, a number of times the heads are driven (printing frequency), and so forth. Therefore, by detecting and measuring these environmental conditions and then adjusting, according to the thus-detected environmental conditions, the power source voltage Vth commonly supplied to the head driving circuits, a printed-image quality can be further improved.

In this case, a logic signal indicating information of the thus-detected and measured environment conditions is supplied to the CPU 132, and the CPU 132 selects a power source voltage Vth based on environment condition information of the logic signal and the head ink-drop firing characteristics. The CPU 132 generates the bit signal representing the thus-selected power source voltage Vth and supplies it to the power source control circuit 133. Thus, the power source voltage Vth commonly supplied to the head driving circuits 105, 106, 107 and 108 is appropriately adjusted.

Figure 27:
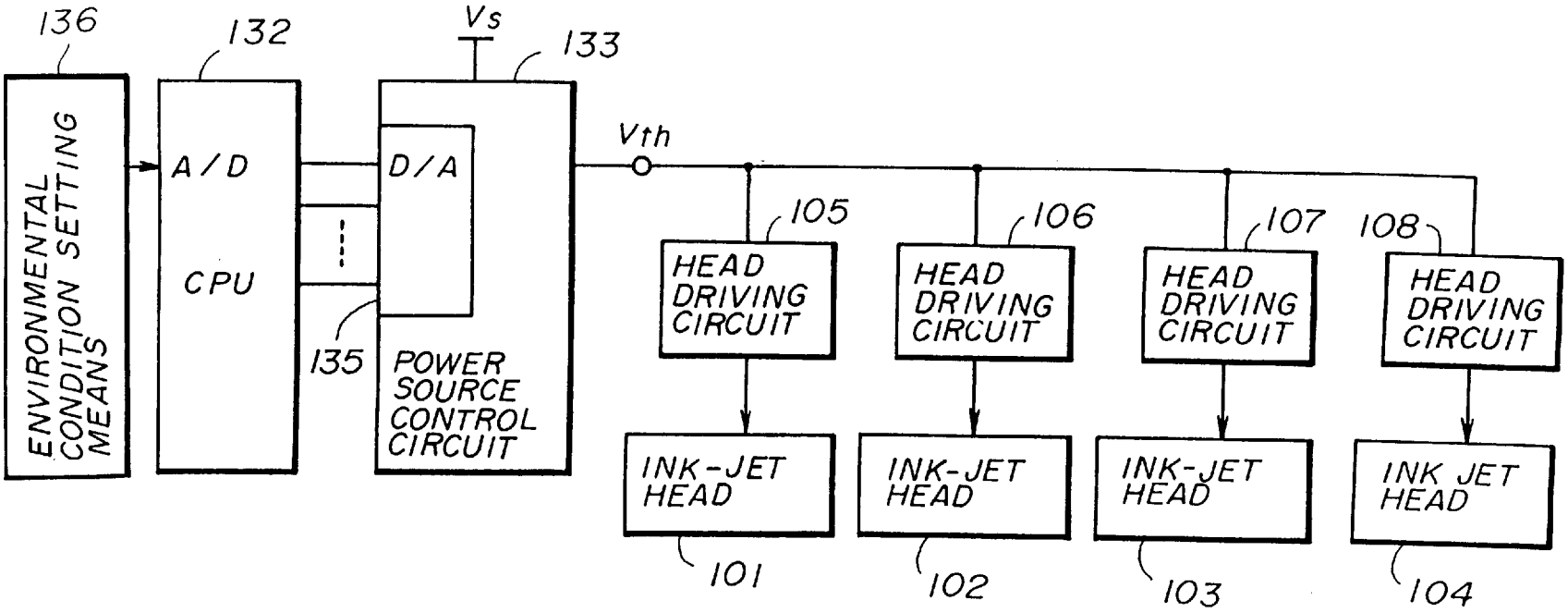
FIG. 27 shows a block diagram of an eleventh embodiment of the present invention.

With reference to FIG. 27, an eleventh embodiment of the present invention will now be described. In this embodiment, an environmental condition setting means 136 is provided and an operator specifies or sets environmental condition information therethrough. The environmental condition information may include the above-mentioned various environmental conditions such as ambient temperature, a kind of recording sheet material used, a time elapsing after power source was supplied, a number of times the heads are driven (printing frequency), and so forth. The environmental condition information set through the environmental condition setting means 136 is input to the CPU 132 similar to that used in the tenth embodiment. The environmental condition setting means 136 may be provided using a host apparatus such as a personal computer or the like, or panel switches (selecting switches) or the like provided on a relevant ink-jet printing apparatus itself.

Thus, in the above-described eleventh embodiment, with a simple arrangement, requires costs can be reduced and also a printed-image quality can be improved. Further it is possible to arbitrarily set a correspondence relationship between the power source voltage and the bit data in the CPU 132. Accordingly, it is possible to further highly accurately adjust the power source voltage supplied to the head driving circuits. Further, for example, if a printing sheet material is different, a dot shape formed as a result of ink being fired thereonto may vary significantly. Further, particular users may make various demands. However, by providing the environment condition setting means 136, it is possible to select an image quality according to the particular users' demands.

It is possible to arrange the environmental condition setting means 136 so that among the various environmental conditions, some which are suitable to be detected are detected by the setting means 136, and some which are suitable to be set by an operator are set through the setting means 136 by the operator. The environmental conditions suitable to be detected are such as ambient temperature, a time elapsing after power source was supplied, a number of times the heads are driven (printing frequency), and those to be set by an operator are such as a kind of recording sheet material used. Specifically, it is possible that the environmental condition setting means 136 includes detecting means for detecting some environmental conditions and setting means for an operator to set other environmental conditions.

Figure 28:
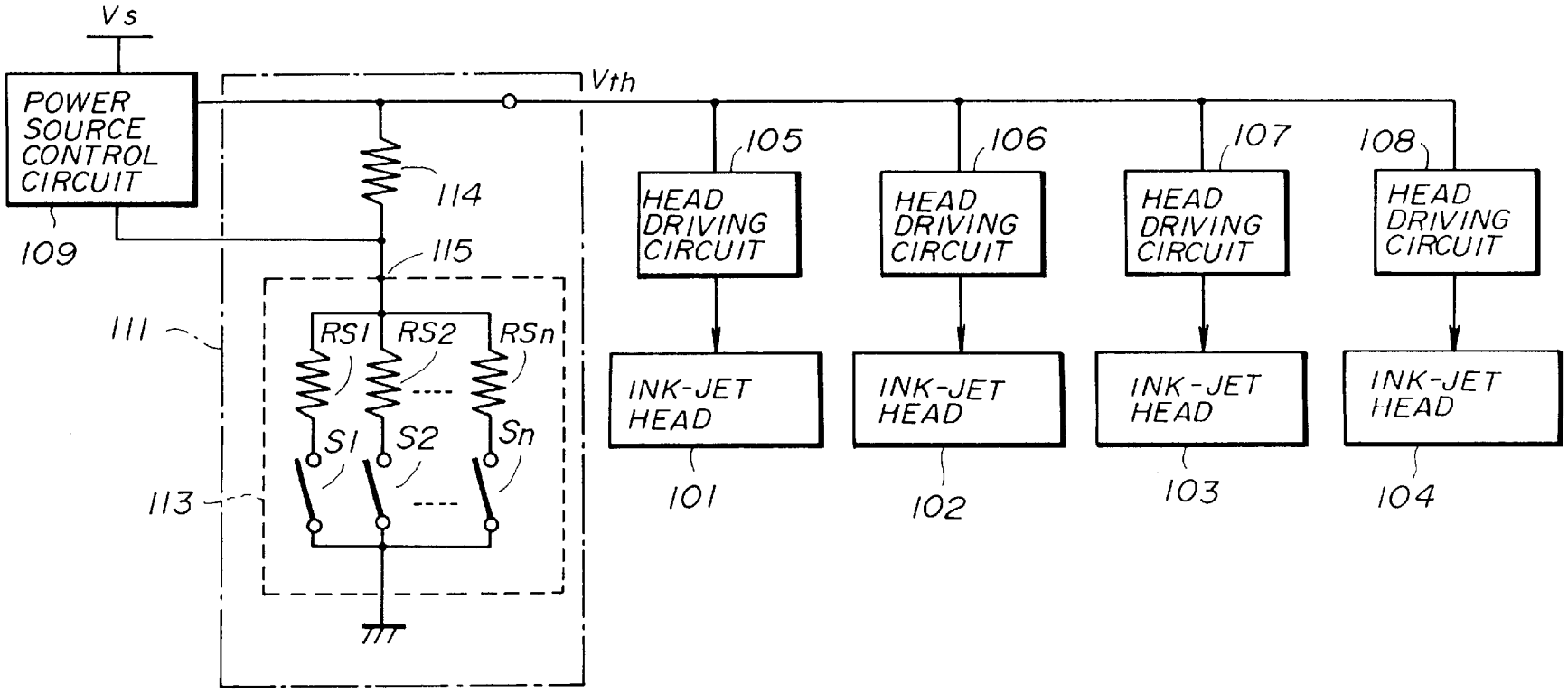
FIG. 28 shows a block diagram of a twelfth embodiment of the present invention.

With reference to FIG. 28, a twelfth embodiment of the present invention will now be described. In this embodiment, an operator specifies or sets environmental condition information. Instead of the series circuit 113 in the ninth embodiment shown in FIG. 21, a parallel circuit 113 is used as shown in FIG. 28. This parallel circuit 113 is one of a plurality of series circuits. Each of the series circuits is one of a respective one of resistors RS1 through RSn having resistances different from one another and a respective one of selecting switches S1 through Sn for selecting, as voltage-distributing resistors, one or more resistors from among the plurality of resistors RS1 through RSn.

In this embodiment, an operator can manipulate the selecting switches S1 through Sn according to environmental conditions. Thereby, an integral resistance of the parallel circuit 113 as the voltage-distributing resistance can be changed and thus a ratio of a resistance of a resistor 114 as the other voltage-distributing resistance to the integral resistance of the parallel circuit 113 can be changed. Thus, the power source voltage Vth commonly supplied to the head driving circuits 105, 106, 107 and 108 can be flexibly adjusted.

Figure 29:
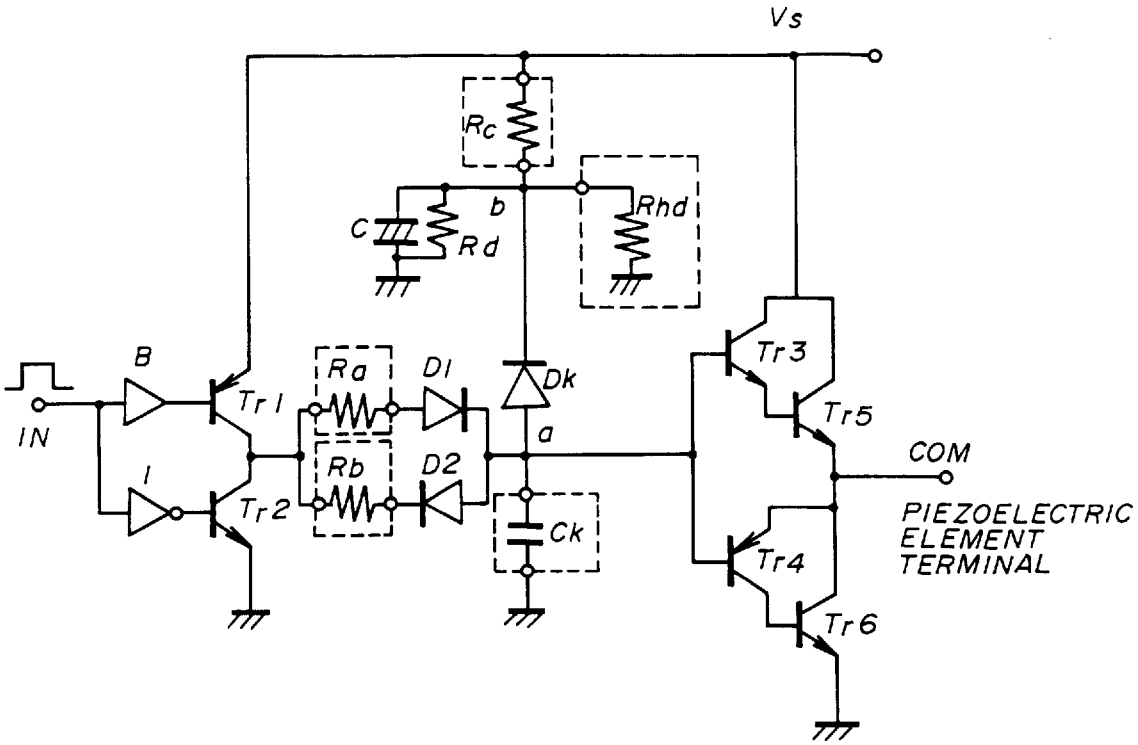
FIG. 29 shows a specific example of a constant-voltage driving circuit in a head driving circuit in a thirteenth embodiment of the present invention.

With reference to FIG. 29, an ink-jet head driving circuit in a thirteenth embodiment of the present invention will now be described. In this embodiment and also in subsequently described embodiments, it is possible to change and thus adjust the peak driving voltages Vp, not higher than the power source voltage Vs supplied to the head driving circuits, of the head driving circuits independently of one another.

In the constant-voltage driving circuit shown in FIG. 29 in the thirteenth embodiment, the power source voltage Vs is supplied to the point b, which corresponds to the point b in the circuit shown in FIG. 24 connected with the cathode of the diode Dk, via a resistor Rc. Further, this point b is also grounded via a parallel circuit of a capacitor C and a resistor Rd and further grounded via a resistor Rhd, as shown in FIG. 29. This resistor Rhd has a special resistance which is selected based on a previously detected relationship between ink-drop firing characteristics of a relevant particular ink-jet head and a driving voltage applied to the ink-jet head. This resistor Rhd is mounted onto the relevant ink-jet head.

In this circuit shown in FIG. 29, the power source voltage Vs is distributed by the resistor Rc and an integral resistor of the resistors Rd and Rhd. As a result a peak voltage Vp special to a relevant particular head is supplied to the point a. A resistance of the resistor Rc will be referred to as rc, and a resistance of the resistor Rd will be referred to as rd, a resistance of Rhd will be referred to as rhd. Further, $$(rd*rhd)/(rd+rhd)=rhd'.$$

Then, a voltage Vb at a point b is obtained by the following equation (7):

$$Vb=Vs*rhd'/(rc+rhd') \quad (7).$$

Figure 30:
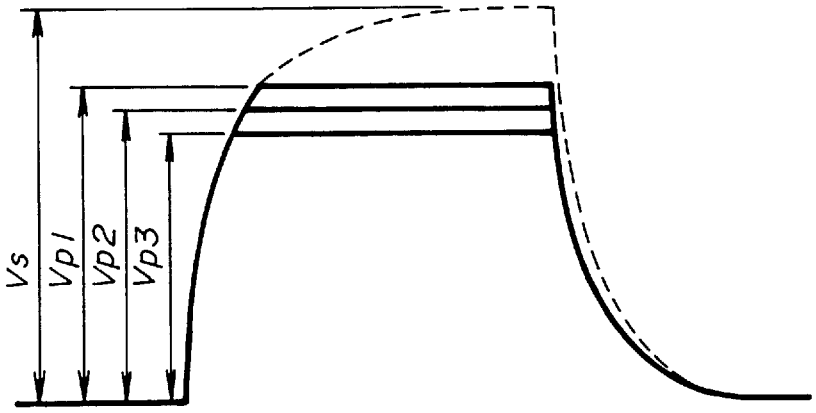
FIG. 30 illustrates a driving voltage waveform output by the constant-voltage driving circuit shown in FIG. 29.

In the above-described constant-voltage driving circuit shown in FIG. 29, when a pulse signal of a square wave is input to the input terminal IN, the transistor Tr1 is an ON state via the buffer B, and the transistor Tr2 is an OFF state via the inverter I. By the power source voltage Vs, charging of the capacitor Ck is performed and thus a voltage at the point a increases gradually with a time constant defined by the resistor Ra and capacitor Ck. As a result, a driving voltage at the common terminal COM gradually increases as shown in FIG. 30. Because the voltage Vb at the point b is supplied to the point a via the diode Dk (dropping voltage is Vd) at this time, a charged voltage of the capacitor Ck does not reach the power source voltage Vs but is clipped at the voltage Vp (where Vp=Vb+Vd). This voltage Vp is the peak voltage Vp of the driving voltage.

Because the voltage Vb depends on the resistance rhd of the resistor Rhd mounted on a relevant particular ink-jet head as shown in the equation (7), it is possible to set the peak voltage Vp special to the relevant particular ink-jet head. For example, three resistors Rhd are mounted onto three ink-jet heads respectively and have resistances rhd1, rhd2 and rhd3 respectively where rhd1>rhd2>rhd3. As a result, as shown in FIG. 30, when the resistor Rhd of the resistance rhd1 is used, the peak voltage Vp is Vp1, when the resistor Rhd of the resistance rhd2 is used, the peak voltage Vp is Vp2, and when the resistor Rhd of the resistance rhd3 is used, the peak voltage Vp is Vp3, where Vp1>Vp2>Vp3.

Figure 31:
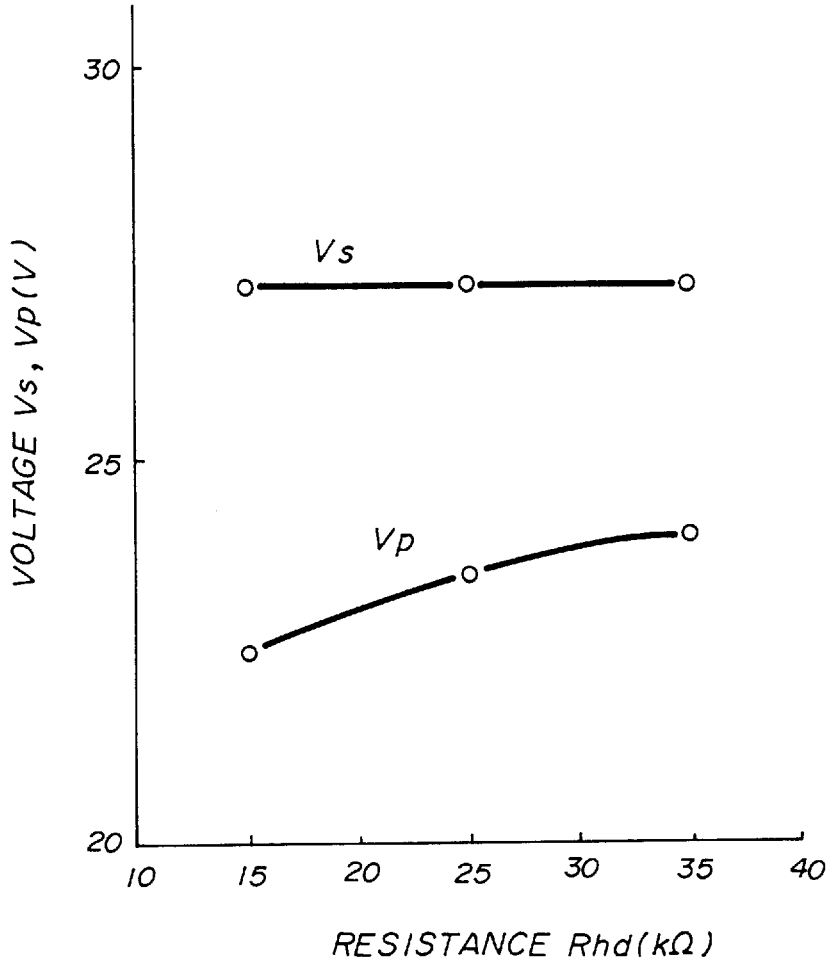
FIG. 31 shows a graph, for illustrating the constant-voltage driving circuit shown in FIG. 29, of an example of a relationship between a resistance value of a resistor Rhd and a power source voltages Vs and Vth.

Thus, as shown in FIG. 31, by adjusting a resistance rhd of the resistor Rhd, when supplying the common fixed-voltage-source voltage Vs to the head driving circuits for the plurality of ink-jet heads, by adjusting a resistance rhd of the resistor Rhd used in the head driving circuits, a desired peak voltage Vp of the head driving voltages can be arbitrarily set for particular ink-jet heads.

In this embodiment, at least part of components used in the waveform generating circuit of each head driving circuit is mounted on a relevant particular ink-jet head. As a result, it is possible to adjust a driving waveform independently for the relevant particular ink-jet head by adjusting a value of the mounted part of the waveform generating circuit. As a result, it is possible to eliminate a difference of ink-drop firing characteristics among particular heads or a difference of ink property among particular ink colors by adjusting driving voltage waveforms of respective heads. Accordingly, it is possible to improve printed image quality with a simple apparatus arrangement and with low costs. Further, the part of the waveform generating circuit mounted onto the respective heads may be adjusted before being shipped. Thereby, when a head is replaced, a new head may be merely fitted into a relevant ink-jet printing apparatus, the new head having the part of the waveform generating circuit which was already appropriately adjusted according to characteristics of the particular head before being shipped as mentioned above. As a result, without adjustment after fitting the new head, a high-quality printed image can be obtained.

Further, in the thirteenth embodiment shown in FIG. 29, at least a resistor in a clipping circuit, clipping the waveform of the driving voltage, in the waveform generating circuit is mounted onto a relevant particular ink-jet head. Thus, it is possible to independently adjust the driving voltage waveform for a particular ink-jet head among the plurality of ink-jet heads. Accordingly, by merely a simple arrangement, a difference of characteristics among the heads can be eliminated.

In this embodiment, the resistor Rhd in the circuit shown in FIG. 29 is mounted on a relevant particular ink-jet head. However, it is also possible to mount the resistor Rc instead of the resistor Rhd. Further, the resistor Rd is provided for reducing power consumption in the resistor Rhd mounted onto a relevant head. Therefore, the resistor Rd may be omitted.

Further, in this embodiment, by changing the resistance of the resistor Rhd, the peak voltage Vp of the driving voltage is changed. However, in order to change the waveform and thus ink-jet read ink firing characteristics, it is also possible to change time constants relevant to the waveform of the driving voltage, that is, to change a rising time constant Tr or A decaying time constant Tf, having approximately the same meanings as those of rise time tr and decay time tf shown in FIG. 9, respectively.

Specifically, in the constant-voltage driving circuit shown in FIG. 29, the resistors Ra and Rb control charging and discharging of the capacitor Ck. In order to adjust the time constants of the driving waveform for a particular ink-jet head, the resistor Ra and/or resistor Rb, or capacitor Ck is mounted on the ink-jet head, and a relevant resistance or capacitance is adjusted to a special one according to characteristics of the particular ink-jet head.

Figure 32:
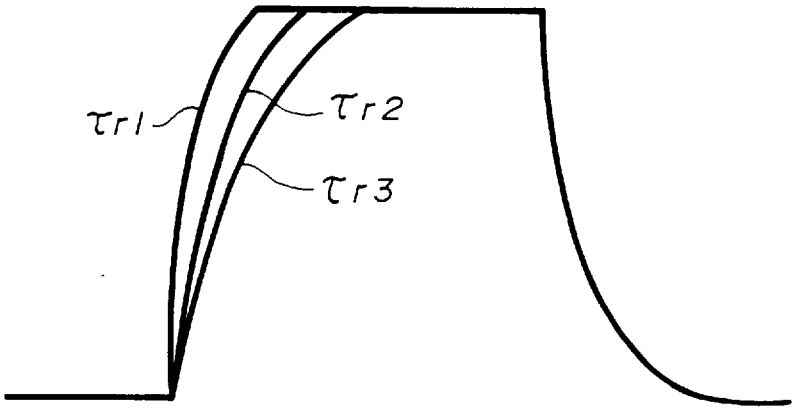
FIG. 32 shows a graph for illustrating a driving voltage waveform when a changing time-constant of the constant-voltage driving circuit shown in FIG. 29 is changed.
Figure 33:
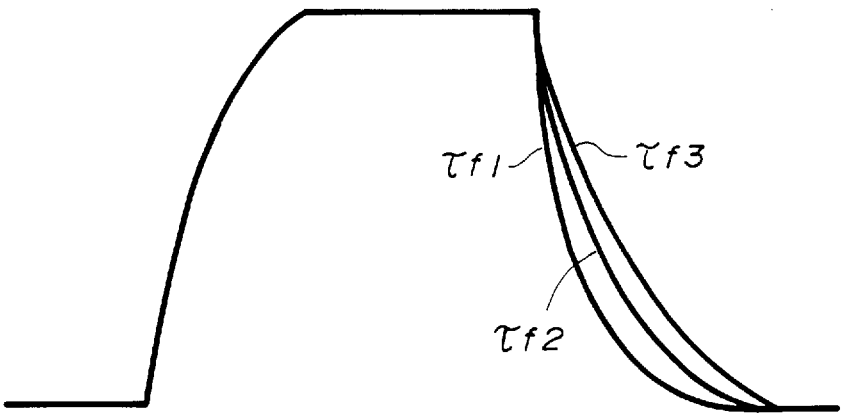
FIG. 33 shows a graph for illustrating a driving voltage waveform when a discharging time-constant of the constant-voltage driving circuit shown in FIG. 29 is changed.

FIG. 32 shows how the driving waveform varies in response to adjusting the rising time constant $\tau r$ as a result of changing the resistance of the resistor Ra. In this example, when changing the resistance of the resistor Ra among ra1, ra2 and ra3, where ra1<ra2<ra3, time constants $\tau r1$, $\tau r2$ and $\tau r3$ are obtained respectively, where $\tau r1<\tau r2<\tau r3$. Further, FIG. 33 shows how the driving waveform varies in response to adjusting the decaying time constant $\tau f$ as a result of changing the resistance of the resistor Rb. In this example, when changing the resistance of the Rb among rb1, rb2 and rb3, where rb1<rb2<rb3, time constants $\tau f1$, $\tau f2$ and $\tau f3$ are obtained respectively, where $\tau f1<\tau f2<\tau f3$. If the capacitance of the capacitor Ck is changed, as the capacitance is larger, each of the rising time constant $\tau r$ and decaying constant $\tau f$ is longer. As the capacitance decreases, each of the rising time constant $\tau r$ and decaying constant $\tau f$ shortens.

Thus, in this embodiment, the waveform generating circuit includes a circuit in which a voltage of a capacitor varies according to charging and discharging thereof via resistors. The varying voltage of the capacitor is used as a driving voltage. At least one of these resistors and capacitor is mounted onto a relevant ink-jet head. As a result, by adjusting a value of a thus-mounted component, a rising time constant and/or a decaying time constant in a waveform of the driving voltage can be adjusted for the relevant particular ink-jet head independently. Thus, it is possible to make ink-drop firing characteristics be uniform among the plurality of ink-jet heads. Accordingly it is possible to prevent a dot printed position on a recording sheet material from unexpectedly differing. Thus, a printed-image quality can be improved. Further, by adjusting the decay time constant of the driving waveform, it is possible to prevent a pressure wave from remaining after ink firing. The remaining pressure wave may degrade a high-frequency driving capability. Even if a difference of the remaining pressure wave levels appears among the plurality of ink-jet heads, by adjusting the decay time constant, the difference can be eliminated and thus frequent driving capability can be improved.

Figure 34:
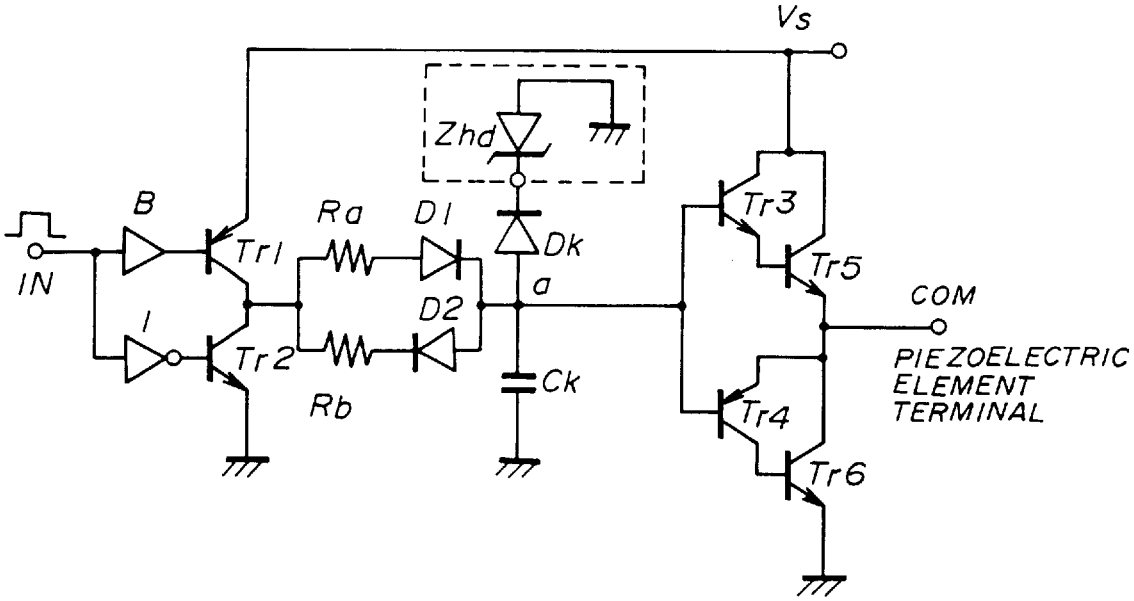
FIG. 34 shows a specific example of a constant-voltage driving circuit in a head driving circuit in a fourteenth embodiment of the present invention.

With reference to FIG. 34, a constant-voltage driving circuit in a fourteenth embodiment of the present invention will now be described. In this embodiment, it is possible to change and thus adjust the peak driving voltages Vp, not higher than the power source voltage Vs supplied to the head driving circuits, of the respective head driving circuits independently of one another.

In this constant-voltage driving circuit, as shown in FIG. 34, a cathode of a Zener diode Zhd is connected to the cathode of the diode Dk in the constant-voltage driving circuit shown in FIG. 24. An anode of this Zener diode Zhd is grounded as shown in FIG. 34. This Zener diode Zhd is mounted on a relevant ink-jet head.

In this constant-voltage driving circuit, the peak voltage Vp of the driving voltage depends on a Zener voltage Vz of the Zener diode Zhd. Therefore, the Zener diode Zhd is selected having the Zener voltage Vz such that the peak driving voltage Vp is appropriate for ink firing characteristics and so forth of the relevant particular ink-jet head. Further, the peak driving voltage Vp of the relevant ink-jet head is arbitrarily set by appropriately selecting the Zener diode Zhd. Thus, a printed image quality can be improved. In such an arrangement in which the Zener diode of the clipping circuit is mounted onto the relevant ink-jet head, by a simple arrangement, a difference among the heads can be eliminated by adjusting the peak driving voltage.

Figure 35:
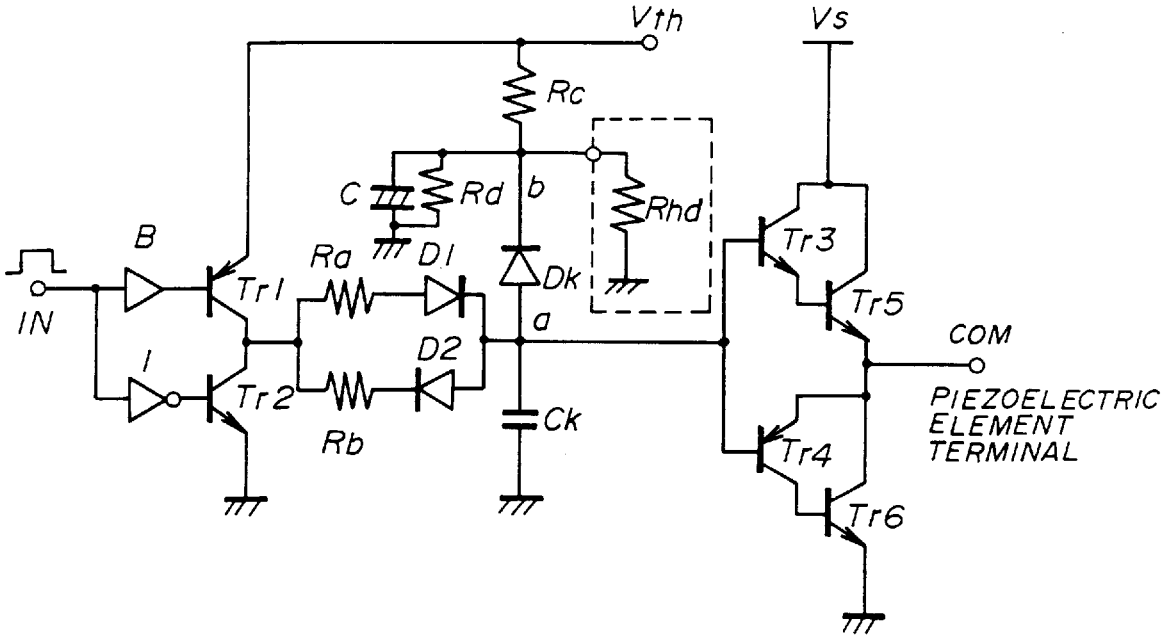
FIG. 35 shows a specific example of a constant-voltage driving circuit in a head driving circuit in a fifteenth embodiment of the present invention.

With reference to FIG. 35, a constant-voltage driving circuit in a fifteenth embodiment in the ink-jet head driving circuit will now be described. In the head driving circuit, the power source voltage Vth supplied to the respective head driving circuits is controlled according to environmental conditions, and also the peak driving voltages Vp are adjusted for the respective head driving circuits independently of one another.

In this constant-voltage driving circuit, as shown in FIG. 35, the power source voltage Vth adjusted according to environmental conditions is supplied to the point b to which the cathode of the diode Dk is connected in the constant-voltage driving circuit shown in FIG. 29, via a resistor Rc. The power source voltage Vth is supplied as a result of applying thereto any one of the above-described ninth, tenth, eleventh and twelfth embodiments. Thus, the power source voltage Vth is adjusted according to environmental conditions (result of detecting or result of setting).

Figure 36:
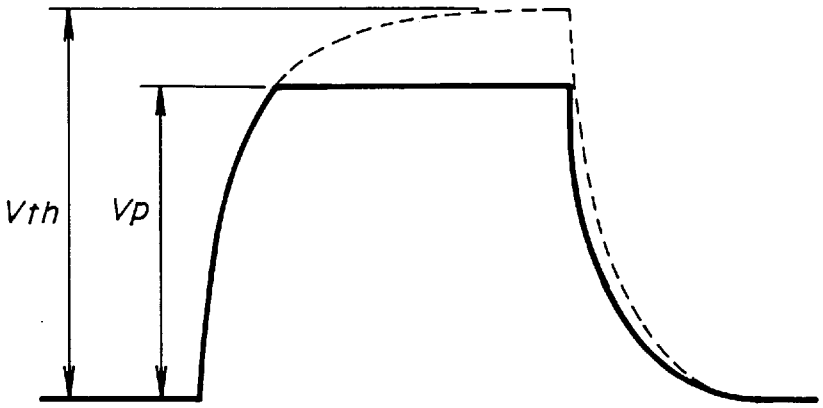
FIG. 36 illustrates a driving voltage waveform output by the constant-voltage driving circuit shown in FIG. 35.

In this constant-voltage driving circuit shown in FIG. 35, the power source voltage Vth is distributed by the resistor Rc and an integral resistor of the resistors Rd and Rhd. Thus, the peak driving voltage Vp is supplied to the point a. Accordingly, as shown in FIG. 36, by adjusting the power source voltage Vth, the peak driving voltages are adjusted commonly for the respective ink-jet heads, and also by adjusting a resistance of the resistor Rhd, the peak driving voltage Vp is adjusted for a relevant particular ink-jet head independently.

Thus, in this embodiment, the power source voltage supplied commonly to the respective head driving circuits is adjusted according to a detection result and/or a set result of the environmental conditions. As a result, the common power source voltage Vth is corrected according to the environmental conditions which may cause the ink-drop firing characteristics of the ink-jet heads to change independently of any possible difference present among the respective ink-jet heads. Further, at least one component of the waveform generating circuit is mounted on a relevant ink-jet head. Then, a value of the mounted component of the waveform generating circuit is adjusted and thus the driving waveform (Vp, $\tau r$, $\tau f$) is adjusted so as to eliminate a possible difference among the heads. Thus, unexpected but possible fluctuations of the ink-drop firing characteristics due to environmental conditions and also due to a possible difference among the heads are effectively corrected.

Figure 37:
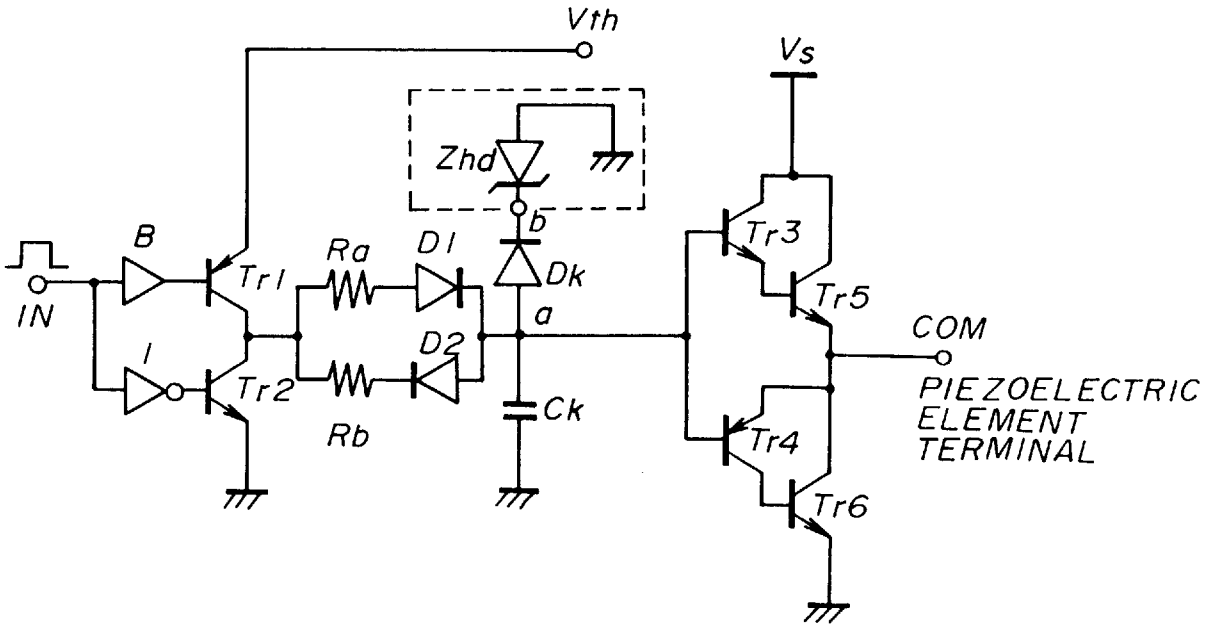
FIG. 37 shows a specific example of a constant-voltage driving circuit in a head driving circuit in a sixteenth embodiment of the present invention.

Further, this fifteenth embodiment is obtained as a result of modifying the embodiment shown in FIG. 29 so that the power source voltage Vth is used as a power source for generating the driving voltage. However, it is also possible to create another embodiment as a result of modifying the embodiment shown in FIG. 34 so that the power source voltage Vth is used as a power source for generating the driving voltage. The resulting embodiment is a sixteenth embodiment shown in FIG. 37. In this sixteenth embodiment, as described above, the Zener diode Zhd is selected having the Zener voltage Vz such that the peak driving voltage Vp is appropriate for ink firing characteristics and so forth of the relevant particular ink-jet head.

Figure 38:
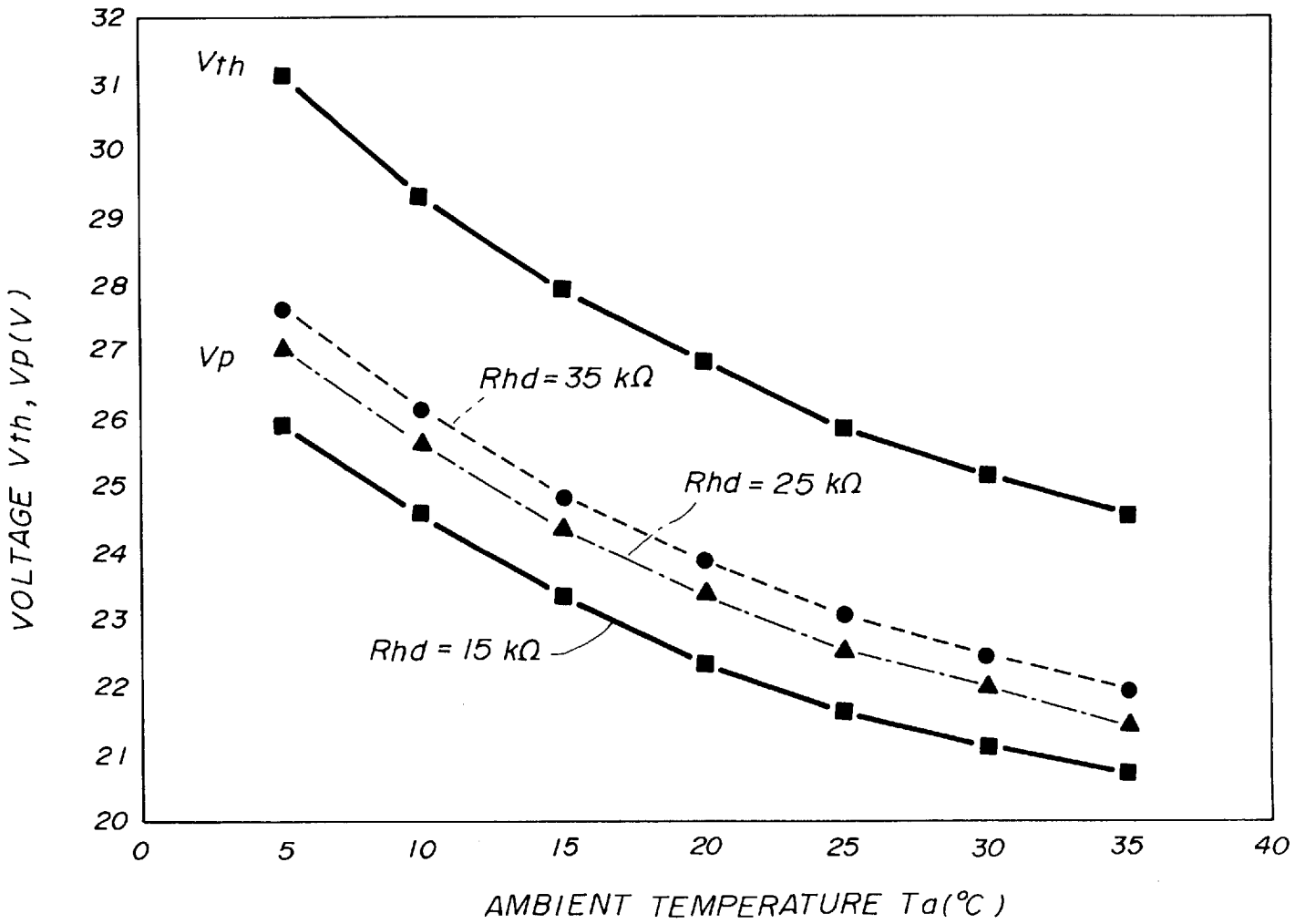
FIG. 38 shows a graph, for illustrating the constant-voltage driving circuit shown in FIG. 37, indicating an example of a relationship between an ambient temperature and voltages Vth and Vp.

FIG. 38 shows an example of how the power source voltage Vth and peak driving voltage Vp vary in a case where the constant-voltage driving circuit shown in FIG. 35 is applied to the ink-jet head driving circuit in the ninth embodiment shown in FIG. 9. In this case, the power source voltage Vth is changed according to the ambient temperature Ta and also the resistance of the resistor Rhd is changed. In this case, the thermistor 110 is 104HT (trade name of SEMITEC), the power source control circuit is the three-terminal regulator LM317 (trade name of National Semiconductor), the resistance R1 of the resistor 114 is 30 kΩ, the resistance Rp of the resistor 111A is 1 MΩ, the resistance Rs of the resistor 112 is 500 kΩ, the resistance rc of the resistor Rc is 2 kΩ, and the resistance rd of the resistor Rd is 20 kΩ. Further, a broken-line curve of the peak driving voltage Vp is one in a case where the resistance of the resistor Rhd is 35 kΩ, a chain-line curve of the peak driving voltage Vp is one in a case where the resistance of the resistor Rhd is 25 kΩ, and a thin-solid-line curve of the peak driving voltage Vp is one in a case where the resistance of the resistor Rhd is 15 kΩ.

Further, as described above, adjustment of a driving waveform for every ink-jet head can be performed not only by changing the peak driving voltage Vp but also by changing rising and decaying time constants by changing values of resistors Ra, Rb, and capacitor Ck.

Figure 39:
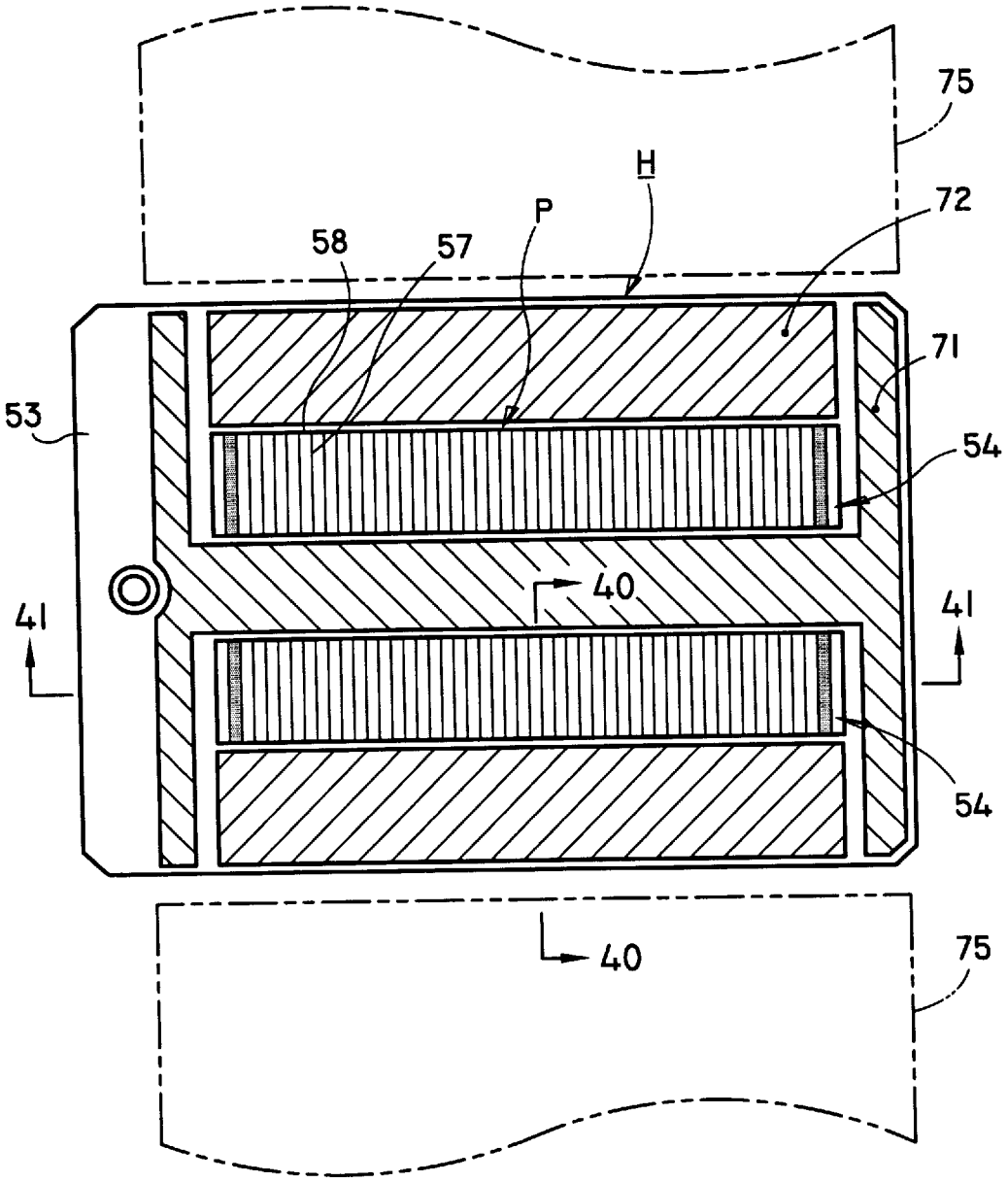
FIG. 39 shows a plan view of an ink-jet head in a state in which a liquid-chamber unit has been removed therefrom.
Figure 40:
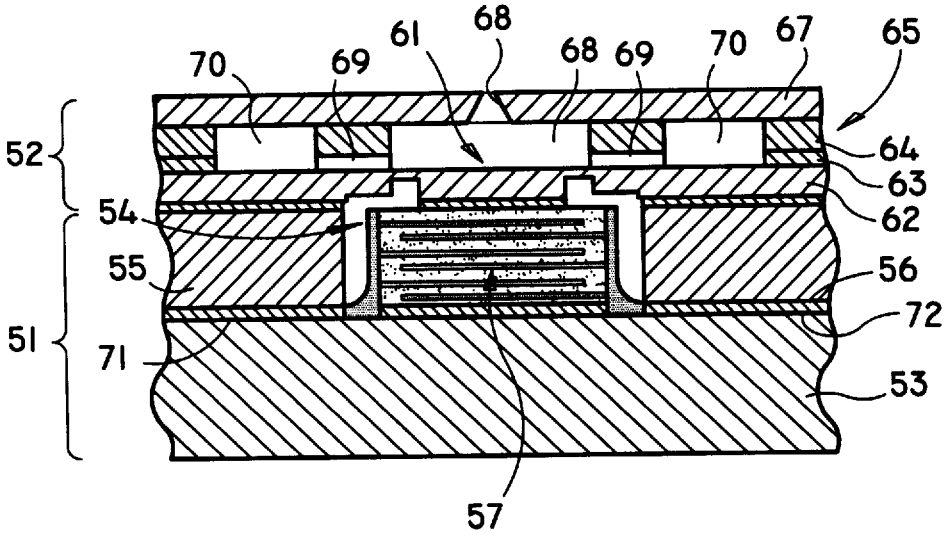
FIG. 40 shows an elevational sectional view of the ink-jet head including the liquid-chamber unit viewed along a A—A line shown in FIG. 39.
Figure 41:
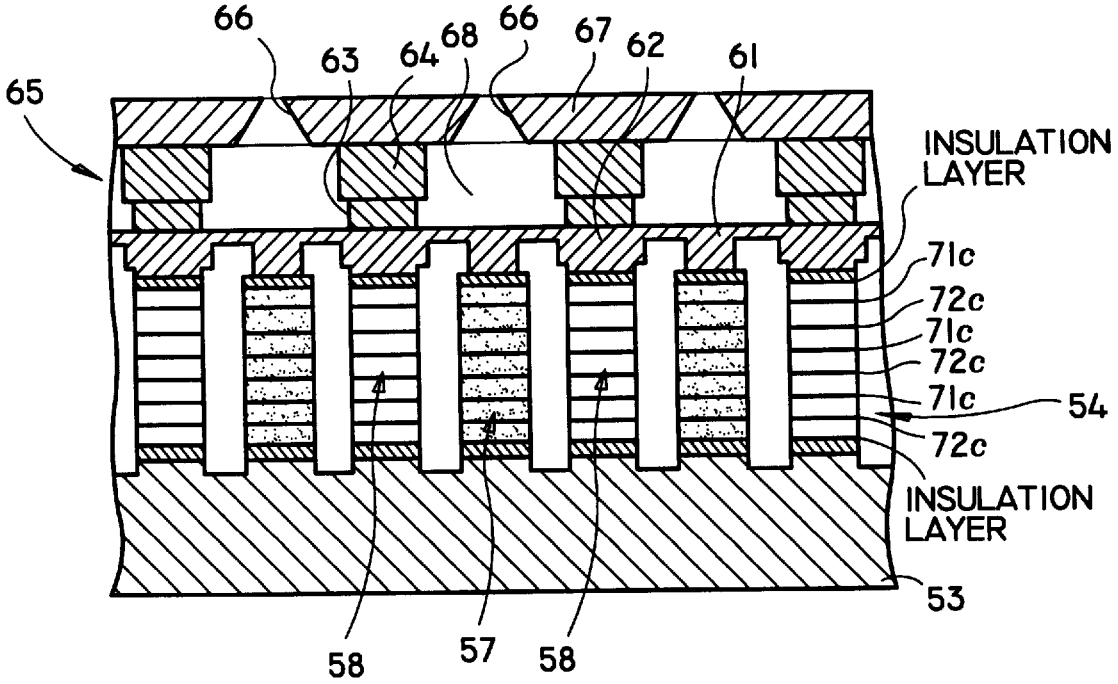
FIG. 41 shows an elevational sectional view of the ink-jet head including the liquid-chamber unit viewed along a B—B line shown in FIG. 39.

With reference to FIGS. 39, 40 and 41, an example of mounting components used in the waveform generating circuit of the constant-voltage driving circuit described above will now be described.

As shown in FIG. 40, the ink-jet head H includes an actuator unit 51 and a liquid-chamber unit 52 bonded to the top of the actuator unit 51. The actuator unit 51 includes a substrate 53 made from ceramic, glass epoxy resin or the like. Further, as shown in FIG. 39, in the actuator unit 51, two rows 54 of laminated piezoelectric elements are fixed on the substrate 53 via a bonding agent 56. Further, frame members 55 are also fixed on the substrate 53 via the bonding agent 56 and surround the two rows 54 of piezoelectric elements.

As shown in FIG. 41, each row 54 of piezoelectric elements includes a plurality of piezoelectric elements 57. Driving pulses are supplied to the piezoelectric elements 57, a pressure is thus applied to ink in a relevant liquid chamber 68 and thus an ink drop is fired from the liquid chamber 68. The piezoelectric element 57 is referred to as 'driving piezoelectric element'. As shown in FIG. 41, each row 54 of piezoelectric elements also includes a plurality of piezoelectric elements 58, each being inserted between adjacent ones of the driving piezoelectric elements 57. The piezoelectric elements 58 are ones to which no driving pulses are supplied, merely act as members supporting the liquid-chamber unit 52, and thus are referred to as 'supporting piezoelectric members'. Thus, an alternate arrangement of the driving piezoelectric elements 57 and supporting piezoelectric elements 58 is formed.

As shown in FIGS. 40 and 41, the liquid-chamber unit 52 includes a vibration plate 62 forming a diaphragm unit 61 and a liquid-chamber flowing-path forming member 65 adhered onto the vibration plate 62. The liquid-chamber flowing-path forming member 65 includes two sheets of photosensitive resin films (dry film resist) 63 and 64 which form the liquid chambers 68, common liquid chambers 70 and so forth. Further, as shown in FIG. 41, a nozzle plate 67 is adhered on the liquid-chamber flowing-path forming member 65. The nozzle plate 16 forms a plurality of nozzles 66. As shown in FIG. 40, the liquid-chamber flowing-path forming member 65 consists of the liquid chamber 68, fluid resistance parts 69 at the both sides of the liquid chamber 68, and also common liquid chambers 70 outside the fluid resistance parts 69.

As shown in FIG. 39, on the substrate 53 of the actuator unit 51, a common conductor pattern 71 is provided between the two rows 54 of piezoelectric elements. Positive terminal electric conductors 71C of all the piezoelectric elements P (the driving piezoelectric elements 57 and supporting piezoelectric elements 58), shown in FIG. 41, are connected to the common conductor pattern 71. Further, a selecting conductor pattern 72 is provided outside the two rows 54 of the piezoelectric elements as shown in FIG. 39. The selecting conductor pattern 72 includes a plurality of separate conductors, each connected to a respective one of negative terminal electric conductors 72C of the piezoelectric elements P shown in FIG. 41. The selecting conductor pattern 72 is separated into the plurality of separate conductors for the respective channels simultaneously with separation of the piezoelectric elements P for the respective channels through slitting processing. An IC forming the constant-voltage driving circuit and channel selecting circuit of the head driving circuit is electrically connected to these common conductor pattern 71 and selecting conductor pattern 72 via FPC cables 75 shown in FIG. 39.

Resistors and/or a capacitor used in the waveform generating circuit is mounted on a relevant ink-jet head as mentioned above for adjusting a driving waveform generated independently for the ink-jet head. This may be mounted on any part used in a relevant ink-jet head. However, by mounting onto a part of the head substrate 53 or FPC cables 75, a space can be effectively reduced. In this case, a resistor or a capacitor should have a value appropriate for ink-drop firing characteristics of a relevant particular ink-jet head as described above. Therefore, a variable-volume-type component or a micro-trimmer-type component is used. Specifically, RVG4M08 (trade name of Murata Corporation), TZV02, 03, TZBX4 series (trade names of Murata Corporation) may be used there for example.

Further, instead of the variable-volume-type component, a component may be formed of a thin layer formed by screen printing or of a thick layer formed by evaporation, sputtering or the like, then a laser trimming is performed and thus a value of a relevant component may be adjusted. Thereby, an area required for mounting the component can be effectively reduced and also costs therefor can be reduced. Further, alternatively, it is also possible to previously form a plurality of resistors having different resistances or a plurality of capacitors having different capacitances together with necessary electric wiring (patterning) at a part of the ink-jet head. Then, appropriate patterns may be cut so as to leave necessary components as effective ones. Thus, a desired value of resistance or capacitance can be obtained.

Figure 42:
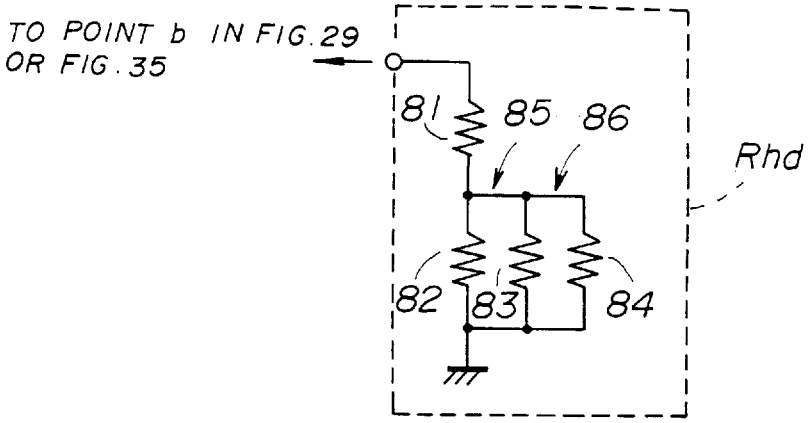
FIG. 42 shows a circuit diagram for illustrating how to select a resistance element of a waveform generating circuit for an ink-jet head.

For example, as shown in FIG. 42, resistors 82, 83 and 84 having resistances different from one another are previously formed by patterning onto a relevant ink-jet head as the above-described resistor Rhd. Then, when either one of a patterned electric wiring 85 between the resistors 82 and 83, and a patterned electric wiring 86 between the resistors 83 and 84 is cut, or neither one is cut, three resistances can be obtained for the resistor Rhd.

Figure 43:
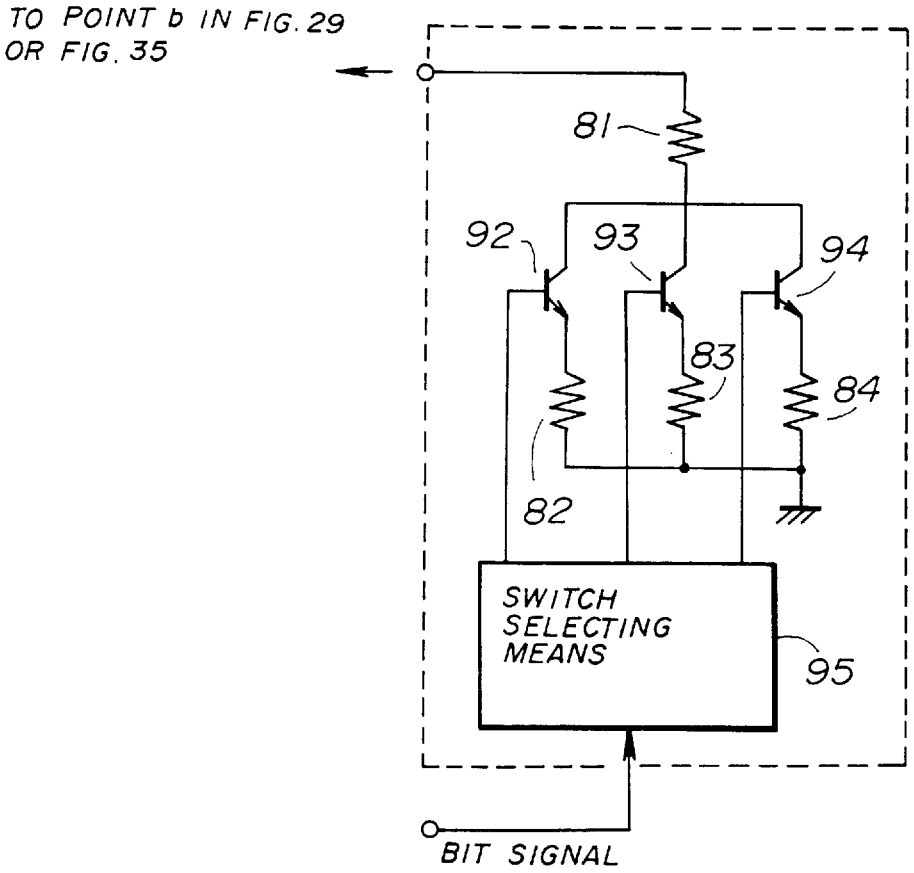
FIG. 43 shows another example of a circuit diagram for illustrating how to select a resistance element of a waveform generating circuit for an ink-jet head.

Further, alternatively, it is also possible that, as shown in FIG. 43, three transistors 92, 93 and 94 are inserted in series with the resistors 82, 83 and 84 used in the circuit shown in FIG. 42 respectively. These transistors 92, 93 and 94 may be replaced with any other electric switching elements. These transistors 92, 93 and 94 are selectively in ON/OFF states by switch selecting means 95 according to a bit signal externally supplied to the means 95, and thus desired ones of the three resistors 82, 83 and 84 are effective in the circuit.

The switch selecting means 95 can be provided using a shift resistor circuit, a latch circuit, a gate circuit and so forth. Further, the bit signal may be supplied by the CPU and alternatively may be supplied by a signal generating apparatus other than the relevant ink-jet printing apparatus. Further, in this case, alternatively it is also possible to use mechanical-contacting-type switches as the switch selecting means instead of the transistors. Then, desired resistors may be selected manually. Further, when a capacitor is mounted on a each ink-jet head, a similar circuit arrangement can be used.

Thus, a plurality of resistors or capacitors and the switch selecting means for selecting at least one of the plurality of resistors or capacitors according to the given bit signal are mounted on each ink-jet head. Thereby, a resistance or a capacitance can be automatically adjusted.

In the above-described embodiments, the piezoelectric elements are used as the actuators. However, the present invention can be similarly applied to an ink-jet printing system using any other actuators such as heating resistance elements for causing bubbles in liquid chambers, energy transducing elements for firing ink, and so forth.

Embodiments of the present invention are not limited to those particularly described above. Other embodiments can result from various combinations of appropriate ones among the above-described embodiments. Further, other embodiments can result from appropriately combining features of the above-described embodiments. Other embodiments can also result from appropriately applying features of one(s) of the above-described embodiments to the other one of the above-described embodiments.

The present invention is not limited to the above-described embodiments, and variations and modifications may be made without departing from the scope of the present invention.

What is claimed is:

1. An ink-jet head driving circuit comprising:

a liquid chamber containing ink;

a piezoelectric element applying pressure to said liquid chamber; and voltage applying means for applying a driving voltage to said piezoelectric element so as to vary the pressure applied to said liquid chamber, wherein said driving voltage is sharply increased immediately after a voltage increase is started so that internal pressure in said liquid chamber is increased, said driving voltage is then gently but substantially increased until said voltage increase ends wherein ink is fired from said liquid chamber, and wherein said driving voltage is decreased so that internal pressure in said liquid chamber is decreased.

2. The ink-jet head driving circuit according to claim 1, wherein said voltage applying means comprises:

voltage increasing means for increasing the driving voltage until reaching a power source voltage; and peak cutting means for preventing the driving voltage from increasing above a predetermined peak driving voltage which is less than said power source voltage.

3. The ink-jet head driving circuit according to claim 2, wherein said voltage increasing means comprises a capacitor and the driving voltage is increased as a result of said capacitor being charged.

4. The ink-jet head driving circuit according to claim 2, wherein said predetermined peak driving voltage is not larger than 9/10 said power source voltage.

5. The ink-jet head driving circuit according to claim 2, wherein said predetermined peak driving voltage is defined by a certain voltage which is obtained as a result of distributing, through resistors, said power source voltage.

6. The ink-jet head driving circuit according to claim 2, wherein a Zener diode is used for limiting the driving voltage at said predetermined peak driving voltage.

7. The ink-jet head driving circuit according to claim 1, wherein:

said liquid chamber comprises a plurality of liquid chambers; and said piezoelectric element comprises a plurality of piezoelectric elements for applying pressure to said plurality of liquid chambers respectively;

and wherein the driving voltage is supplied to said plurality of piezoelectric elements using a common conductor.

8. An ink-jet head driving circuit comprising:

a liquid chamber containing ink;

a piezoelectric element applying pressure to said liquid chamber; and voltage applying means for applying a driving voltage to said piezoelectric element so as to vary the pressure applied to said liquid chamber, wherein said driving voltage is increased so as to increase the pressure in said liquid chamber, said driving voltage being increased such that a minimum per-time voltage-increase gradient during a time the driving voltage is being increased is not less than 1/8 a maximum per-time voltage-increase gradient during said time the driving voltage is being increased, and wherein said driving voltage is then increased until said voltage increase ends wherein ink is fired from said liquid chamber, and wherein said driving voltage is decreased so that internal pressure in said liquid chamber is decreased.

9. An ink-jet head driving circuit comprising:

a liquid chamber containing ink;

a piezoelectric element applying pressure to said liquid chamber; and voltage applying means for applying a driving voltage to said piezoelectric element so as to vary the pressure applied to said liquid chamber, wherein said driving voltage is increased so as to increase the pressure in said liquid chamber, said driving voltage is then increased by an amount during a time, within a predetermined time, in which a per-time voltage-increase gradient is maintained at a maximum, which is not less than ½ of a full driving-voltage increase amount which the driving voltage is increased during said predetermined time.

10. An ink-jet head driving circuit comprising:

a liquid chamber containing ink;

a piezoelectric element applying pressure to said liquid chamber; and voltage applying means for applying a driving voltage to said piezoelectric element so as to vary the pressure applied to said liquid chamber;

wherein said driving voltage is increased so as to increase the pressure in said liquid chamber and said driving voltage is further increased such that after said increase ends ink is fired from said liquid chamber;

wherein said driving voltage is decreased such that a per-time voltage-decrease gradient when said voltage decrease is started is sharper than an average per-time voltage-decrease gradient, and such that a per-time voltage-decrease gradient when said voltage decrease is ended is less sharp than the average per-time voltage-decrease gradient; and wherein a time during which a per-time voltage-decrease gradient is maintained less sharp than said average per-time voltage-decrease gradient is not less than ½ a full time during which the driving voltage is being decreased.

11. An ink-jet head driving circuit comprising:

a plurality of head driving circuits, relevant to a plurality of ink-jet heads respectively;

environmental condition detecting means, detecting environmental conditions; and voltage control means for commonly adjusting a driving voltage applied to said plurality of head driving circuits based on a detection result of said environmental condition detecting means.

12. The ink-jet head driving circuit according to claim 11, wherein said environmental condition detecting means comprises a resistor circuit including a thermistor detecting an ambient temperature.

13. An ink-jet head driving circuit comprising:

a plurality of head driving circuits, relevant to a plurality of ink-jet heads respectively;

environmental condition detecting means, detecting environmental conditions;

data processing means, based on a detection result of said environmental condition detecting means, generating a bit signal representing a driving voltage commonly applied to said plurality of head driving circuits;

voltage control means, commonly adjusting the driving voltage applied to said plurality of head driving circuits according to said bit signal.

14. An ink-jet head driving circuit comprising:

a plurality of head driving circuits, relevant to a plurality of ink-jet heads respectively;

environmental condition setting means for an operator to set environmental conditions;

data processing means, based on a setting performed through said environmental condition setting means, generating a bit signal representing a driving voltage commonly applied to said plurality of head driving circuits;

voltage control means, commonly adjusting the driving voltage applied to said plurality of head driving circuits according to said bit signal.

15. An ink-jet head driving circuit comprising a plurality of head driving circuits, relevant to a plurality of ink-jet heads respectively, each head driving circuit including a waveform generating circuit generating a driving waveform to be applied to a respective one of said plurality of ink-jet heads, at least one component of said waveform generating circuit being mounted on said respective one of said plurality of ink-jet heads, and thus enabling change of the driving waveform for each ink-jet head independently from the others of said plurality of ink-jet heads.

16. The ink-jet head driving circuit according to claim 15 wherein:

further, a power source voltage is supplied commonly to said plurality of head driving circuits; and said power source voltage is adjusted according to environmental conditions.

17. The ink-jet head driving circuit according to claim 15, wherein:

said waveform generating circuit of each head driving circuit includes a clipping circuit clipping a driving voltage of the driving waveform; and at least one resistor or Zener diode used in said clipping circuit is mounted on a respective one of said plurality of ink-jet heads, and thus a change in the driving voltage of the driving waveform is enabled for each ink-jet head independently from the others of said plurality of ink-jet heads.

18. The ink-jet head driving circuit according to claim 15, wherein said waveform generating circuit of each head driving circuit includes a circuit generating, as the driving waveform, a voltage waveform relevant to a capacitor which is charged and discharged via a resistor; and at least one of said resistor and capacitor is mounted on a respective one of said plurality of ink-jet heads, and thus changes in a rising time constant and a decaying time constant of the driving waveform are enabled for each ink-jet head independently from the others of said plurality of ink-jet heads.

19. The ink-jet head driving circuit according to claim 15, wherein a plurality of resistors or capacitors and switch selecting means selecting at least one of said plurality of resistors or capacitors according to a given bit signal are mounted on each of said plurality of ink-jet heads.

20. An ink-jet head comprising:

a liquid chamber containing ink;

a piezoelectric element applying pressure to said liquid chamber; and voltage driving circuit that applies a driving voltage to said piezoelectric element and varies the pressure applied to said liquid chamber, wherein said voltage driving circuit applies a driving voltage that increases with a first gradient so that internal pressure in said liquid chamber is increased, and then increases with a second gradient until said voltage increase ends wherein ink is fired from said liquid chamber, and then decreases so that internal pressure in said liquid chamber is decreased.

21. The ink-jet head according to claim 20, wherein said first gradient is such that a minimum per-time voltage-increase during a time the driving voltage is being increased is not less than ⅛ a maximum per-time voltage-increase gradient during said time the driving voltage is being increased.

22. The ink-jet head according to claim 20, wherein an amount of said second gradient during a time, within a predetermined time, in which a per-time voltage-increase gradient is maintained at a maximum, is not less than ½ of a full driving-voltage increase amount which the driving voltage is increased during said predetermined time.

23. The ink-jet head according to claim 20, wherein said driving voltage is decreased such that a per-time voltage-decrease gradient when said voltage decrease is started is sharper than an average per-time voltage-decrease gradient, and such that a per-time voltage-decrease gradient when said voltage decrease is ended is less sharp than the average per-time voltage-decrease gradient, and wherein a time during which a per-time voltage-decrease gradient is maintained less sharp than said average per-time voltage-decrease gradient is not less than ½ a full time during which the driving voltage is being decreased.

* * * * *